United States Patent [19]

Vetter et al.

[11] Patent Number: 5,006,457

[45] Date of Patent: Apr. 9, 1991

[54] PHOTOGRAPHIC RECORDING MATERIAL

[75] Inventors: Hans Vetter, Cologne; Hans Öhlschläger, Bergisch Gladbach; Heinrich Odenwälder, Leverkusen; Bernhard Morcher, Leverkusen; Friedhelm Sommer, Leverkusen; Lothar Rosenhahn, Cologne, all of Fed. Rep. of Germany

[73] Assignee: Bayer Aktiengesellschaft, Leverkusen-Bayerwerk, Fed. Rep. of Germany

[21] Appl. No.: 434,927

[22] Filed: Nov. 9, 1989

[30] Foreign Application Priority Data

Nov. 12, 1988 [DE] Fed. Rep. of Germany ..... 3838493

[51] Int. Cl.[5] ..... G03C 1/34

[52] U.S. Cl. ..... 430/613; 430/607; 430/503

[58] Field of Search ..... 430/613, 607, 503

[56] References Cited

U.S. PATENT DOCUMENTS 2,353,754 7/1944 Peterson ..... 430/613

*Primary Examiner*—Charles L. Bowers, Jr.
*Assistant Examiner*—Thorl Chea
*Attorney, Agent, or Firm*—Connolly and Hutz

[57] ABSTRACT

The invention relates to a photographic recording material comprising a layer support and, arranged thereon, at least one photosensitive silver halide emulsion layer which contains an antifogging agent corresponding to formula (I)

(I)

in which A, $R_1$ and $R_2$ are as defined in the specification.

The antifogging agents according to the invention reduce fogging without significantly affecting gradation and improve the stability of the photographic material in storage.

2 Claims, No Drawings

PHOTOGRAPHIC RECORDING MATERIAL

This invention relates to a photographic recording material comprising a layer support and at least one photosensitive silver halide emulsion layer arranged thereon.

According to the invention, the material contains special triazoles as antifogging agents.

Recording materials containing photosensitive silver halide emulsions, particularly chemically sensitized emulsions, are known to have a tendency towards fogging produced by nuclei which can be developed without exposure.

It is known that so-called antifogging agents or stabilizers, for example heterocyclic compounds containing sulfur, for example in the form of a mercapto group, may be added to photographic silver halide emulsions to reduce fogging, cf. for example DE-ASS 1,183,371 (GB 1,067,066), 1,189,380 (U.S. Pat. Nos. 3,364,028 and 3,365,294), 1,597, 503 (U.S. Pat. No. 3,615,617), DE 1,979,027 and DE-OSS 1,522,363 (GB 1,186,441), 2,042,533 (U.S. Pat. No. 3,761,278), 2,130,031 and 2,308,530.

In addition, these compounds are used for adapting the sensitivity of the emulsions to the relevant standard in the event of variations in production.

Where the standard antifogging agents mentioned above are used to reduce sensitivity, flattening of the gradation curve of the particular silver halide emulsion occurs as an unwanted side effect.

Now, the object of the present invention is to provide a photographic recording material in which, in the event of production variations, the sensitivity of the silver halide emulsions can be regulated in accordance with the relevant standard without any flattening of gradation.

The present invention relates to a photographic recording material comprising a layer support and at least one photosensitive silver halide emulsion layer arranged thereon, characterized in that the at least one silver halide emulsion layer contains an antifogging agent corresponding to formula (I)

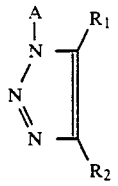

(I)

in which

A represents H, the cation of a metal atom or non-metal group, a group attached by a covalent bond to the nitrogen atom of the triazole which is only eliminated during processing of the material with release of the triazole, represents H, optionally substituted $C_1$–$C_9$ alkyl, $C_2$–$C_8$ alkenyl, $C_6$–$C_{10}$ aryl, $SR_3$, $R_2$ represents H, optionally substituted $C_1$–$C_9$ alkyl, $C_2$–$C_8$ alkenyl, $C_6$–$C_{10}$ aryl, $C_5$–$C_{10}$ heteroaryl, Cl, Br, —$COOR_3$, —$COR_3$, —$OCOR_3$, $R_3$ represents optionally substituted $C_1$–$C_9$ alkyl, $C_2$–$C_8$ alkenyl, $C_6$–$C_{10}$ aryl, $C_5$–$C_{10}$ heteroaryl, the sum of the carbon atoms in the substituents $R_1$, $R_2$ and $R_3$ being equal to or greater than 5 where $R_2$ is a carboxylic ester group.

Examples of cations of a metal atom of group A are $Na^{(+)}$, $K^{(30)}$, $Mg^{2(+)}$ and $Zn^{2(+)}$; one example of a cation of a non-metal group is $NH_4^{(+)}$.

Suitable heteroaryl radicals are, for example, thiophene, furane, 1,2,4-triazole and pyridine.

The following are examples of groups which are attached to the nitrogen atom by a covalent bond and which can be released during processing of the photographic material:

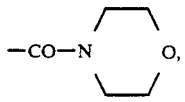

—CO—$N(CH_3)_2$, —CO—$CH_3$, —$SO_2$—$N(CH_3)_2$ and $SO_2$—$CH_3$.

Suitable substituents for $R_1$, $R_2$ and $R_3$ are typical substituents in the field of photographic antifogging agents, such as halogen, particularly chlorine or bromine, $C_1$–$C_4$ alkoxy groups, $C_1$–$C_4$ alkoxy carbonyl, $C_6$–$C_{10}$ aryloxy carbonyl and $C_1$–$C_4$ alkyl carbonyloxy.

In addition, aryl and heteroaryl may be substituted by $C_1$–$C_8$ alkyl.

Suitable examples are the following compounds according to the invention in which the group A represents hydrogen.

| | $R_1$ | $R_2$ |
|---|---|---|
| A-1 | —S—$(CH_2)_5CH_3$ | H |
| A-2 | —S—$(CH_2)_7CH_3$ | H |
| A-3 | —S—$(CH_2)_3CH_3$ | H |
| A-4 | —S—$(CH_2)_4CH_3$ | H |
| A-5 | —S—CH($CH_3$)—$C_2H_5$ | H |
| A-6 | —S—CH($CH_3$)—$(CH_2)_2CH_3$ | H |

-continued

| | $R_1$ | $R_2$ |
|---|---|---|
| A-7 | $-S-CH_2-CH_2OCO-$ 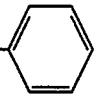 | H |
| A-8 | $-S-CH_2-CH_2OCO-$ 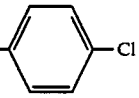 $-Cl$ | H |
| A-9 | $-S-CH_2-CH_2OCO-$ 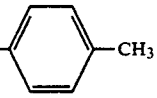 $-CH_3$ | H |
| A-10 | $Cl$ 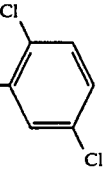 $Cl$ $-S-CH_2-CH_2OCO-$ | H |
| A-11 | $-S-CH_2CH_2-COOC_3H_7$ | H |
| A-12 | $-S-CH_2-C\equiv CH$ | H |
| A-13 | $-S-CH_2-OCOC(CH_3)_3$ | H |
| A-14 | $-S-CH_2CH_2-OCO(CH_2)_4CH_3$ | H |
| A-15 | $-S-CH_2-C(CH_3)_2-COOC_2H_5$ | H |
| A-16 | $-S-(CH_2)_5CH_3$ | $-COOCH_3$ |
| A-17 | $-CH_3$ | $-COO-CH(CH_3)-CH_2CH(CH_3)_2$ |
| A-18 | $-CH_3$ | $-COO-(CH_2)_2-CH(CH_3)CH_3$ |
| A-19 | $-CH_3$ | $-COO-(CH_2)_6-CH_3$ |
| A-20 | $-CH_3$ | $-COO-(CH_2)_8-CH_3$ |
| A-21 | $-CH_3$ | $-COO-(CH_2)_5-CH_3$ |
| A-22 | $-CH_3$ | $-COO-(CH_2)_7-CH_3$ |
| A-23 | $-CH_3$ | $-COO-(CH_2)_2-S-C_2H_5$ |
| A-24 | $-CH_3$ | $-COO-CH_2-COO(CH_2)_3CH_3$ |
| A-25 | $-CH_3$ | $-COO$ 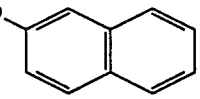 |
| A-26 | $-S-C_2H_5$ | $-COO-(CH_2)_2-S-C_2H_5$ |
| A-27 | $-H$ | 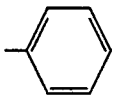 |
| A-28 | $-S-(CH_2)_3CH_3$ | $-COO-$ 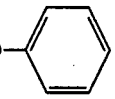 |
| A-29 | $-CH_2-S-(CH_2)_3-CH_3$ | $-COO-C_2H_5$ |

-continued

| $R_1$ | $R_2$ |
|---|---|
| A-30 $-CH_3$ | 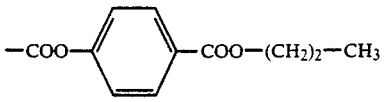 |
| A-31 $-CH_3$ | 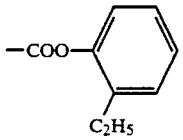 |
| A-32 $-CH_3$ | 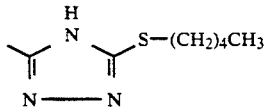 |
| A-33 $-S-CH_3$ | 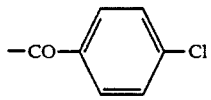 |
| A-34 $-S-CH_3$ | 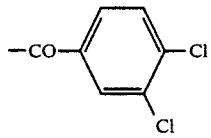 |

The antifogging agents according to the invention are used in a quantity of from $10^{-5}$ to $10^{-2}$ and preferably in a quantity of from 1 to $5\times10^{-3}$ mol per mol silver halide.

The compounds are produced by known methods which are described for example in the following literature: For $R_1$=alkyl, aryl and $R_2$=carboxylic ester group, see Klein et al: J. Heterocyclic Chem. 13, 589 (1976). The exchange of the alcohol component of the ester can be obtained by transesterification at 60° to 100° C. using sodium alcoholate as catalyst.

For $R_1$=alkylthio and $R_2$=carboxylic ester group, see Nemeryuk et al, Coll. Czech. Chem. Commun. 51, 215 (1981) and Goerdeler et al, Ber. 99, 1618 (1966).

For $R_1$=alkylthio and $R_2$=alkanoyl or aroyl, see R. T. Chakrasuli et al: Synthesis 1988, 453.

Alkylthio-1,2,3-triazoles can be obtained from 5-mercapto-1,2,3-triazole, for example by alkylation with alkyl bromides.

1,2,4-Triazole-substituted 1,2,3-triazoles can be produced in the usual way by ring closure of a 1,2,3-triazole carboxylic acid ester with thiosemicarbazide.

Examples of photographic materials are black-and-white films, color negative films, color reversal films, color positive films, color photographic paper, color reversal photographic paper, dye-sensitive materials for the dye diffusion transfer process or the silver dye bleaching process.

Color photographic recording materials comprising a transparent layer support and—arranged thereon—at least three photosensitive silver halide emulsion layers of different spectral sensitivity, with which a yellow coupler, a magenta coupler and a cyan coupler are respectively spectrally associated, are preferred.

Suitable supports for the production of color photographic materials are, for example, films of semisynthetic and synthetic polymers, such as cellulose nitrate, cellulose acetate, cellulose butyrate, polystyrene, polyvinyl chloride, polyethylene terephthalate and polycarbonate, and paper laminated with a baryta layer or α-olefin polymer layer (for example polyethylene). These supports may be dyed with dyes and pigments, for example titanium dioxide. They may also be dyed black for the purpose of screening against light. The surface of the support is generally subjected to a treatment to improve the adhesion of the photographic emulsion layer, for example to a corona discharge with subsequent application of a substrate layer.

The color photographic materials normally contain at least one red-sensitive, at least one green-sensitive and at least one blue-sensitive silver halide emulsion layer and, optionally, intermediate layers and protective layers.

Binder, silver halide grains and color couplers are essential constituents of the photographic emulsion layers.

Gelatine is preferably used as binder although it may be completely or partly replaced by other synthetic, semisynthetic or even naturally occurring polymers. Synthetic gelatine substitutes are, for example, polyvinyl alcohol, poly-N-vinyl pyrrolidone, polyacrylamides, polyacrylic acid and derivatives thereof, particularly copolymers. Naturally occurring gelatine substitutes are, for example, other proteins, such as albumin or casein, cellulose, starch or alginates. Semisynthetic gelatine substitutes are generally modified natural products. Cellulose derivatives, such as hydroxyalkyl cellulose, carboxymethyl cellulose, and phthalyl cellulose and also gelatine derivatives which have been obtained by reaction with alkylating or acylating agents or by grafting on of polymerizable monomers are examples of such modified natural products.

The binders should contain an adequate number of functional groups, so that sufficiently resistant layers can be produced by reaction with suitable hardeners. Functional groups of the type in question are, in particular, amino groups and also carboxyl groups, hydroxyl groups and active methylene groups.

The gelatine preferably used may be obtained by acidic or alkaline digestion. Oxidized gelatine may also be used. The production of such gelatines is described, for example, in The Science and Technology of Gelatine, edited by A. G. Ward and A. Courts, Academic Press 1977, pages 295 et seq. The particular gelatine used should contain as few photographically active impurities as possible (inert gelatine). Gelatines of high viscosity and low swelling are particularly advantageous.

The silver halide present as photosensitive constituent in the photographic material may contain as halide chloride, bromide or iodide and mixtures thereof. For example, 0 to 15 mol-% of the halide of at least one layer may consist of iodide, 0 to 100 mol-% of chloride and 0 to 100 mol-% of bromide. Silver bromide iodide emulsions are normally used in the case of color negative and color reversal films while silver chloride bromide emulsions are normally used in the case of color negative and color reversal paper. The silver halide may consist of predominantly compact crystals which may have, for example, a regular cubic or octahedral form or transitional forms. However, the silver halide may also consist with advantage of platelet-like crystals of which the average diameter-to-thickness ratio is preferably at least 5:1, the diameter of a crystal being defined as the diameter of a circle with an area corresponding to the projected area of the crystal. However, the layers may also contain tabular silver halide crystals in which the diameter-to-thickness ratio is considerably greater than 5:1, for example from 12 1 to 30:1.

The silver halide grains may also have a multiple-layer grain structure, in the most simple case with an inner and an outer core region (core/shell), the halide composition and/or other modifications such as, for example, doping of the individual grain regions, being different. The average grain size of the emulsions is preferably between 0.2 μm and 2.0 μm; the grain size distribution may be both homodisperse and heterodisperse. A homodisperse grain size distribution means that 95% of the grains differ from the average grain size by no more than ±30%. In addition to the silver halide, the emulsions may also contain organic silver salts, for example silver benztriazolate or silver behenate.

Two or more types of silver halide emulsions prepared separately may also be used in the form of a mixture.

The photographic emulsions may be prepared from soluble silver salts and soluble halides by various methods (cf. for example P. Glafkides, Chimie et Physique Photographique, Paul Montel, Paris (1967); G. F. Duffin, Photographic Emulsion Chemistry, The Focal Press, London (1966); V. L. Zelikman et al, Making and Coating Photographic Emulsions, The Focal Press, London (1966)).

Precipitation of the silver halide is preferably carried out in the presence of the binder, for example gelatine, and may be carried out in the acidic, neutral or alkaline pH range, silver halide complexing agents preferably being additionally used. Silver halide complexing agents are, for example, ammonia, thioether, imidazole, ammonium thiocyanate or excess halide. The water-soluble silver salts and the halides are combined either successively by the single-jet process or simultaneously by the double-jet process or by any combination of both processes. The addition is preferably made at increasing inflow rates, although the "critical" feed rate at which new nuclei are still just not formed should not be exceeded. The pAg range may be varied within wide limits during precipitation. It is preferred to apply the so-called pAg-controlled method in which a certain pAg value is kept constant or the pAg value passes through a defined profile during precipitation. However, in addition to the preferred precipitation in the presence of an excess of halide, so-called inverse precipitation in the presence of an excess of silver ions is also possible. The silver halide crystals may be grown not only by precipitation, but also by physical ripening (Ostwald ripening) in the presence of excess halide and/or silver halide complexing agents. The emulsion grains may even be predominantly grown by Ostwald ripening, for which purpose a fine-grained, so-called Lippmann emulsion is preferably mixed with a less readily soluble emulsion and dissolved in and allowed to crystallize therefrom.

Salts or complexes of metals, such as Cd, Zn, Pb, Tl, Bi, Ir, Rh, Fe, may be present during the precipitation and/or physical ripening of the silver halide grains.

In addition, precipitation may even be carried out in the presence of sensitizing dyes. Complexing agents and/or dyes may be inactivated at any time, for example by changing the pH value or by an oxidative treatment.

On completion of crystal formation or even at an earlier stage, the soluble salts are removed from the emulsion, for example by noodling and washing, by flocculation and washing, by ultrafiltration or by ion exchangers.

The silver halide emulsion is generally subjected to chemical sensitization under defined conditions (pH, pAg, temperature, gelatine, silver halide and sensitizer concentration) until sensitivity and fogging are both optimal. The process is described, for example, in H. Frieser "Die Grundlagen der Photographischen Prozesse mit Silberhalogeniden", pages 675–734, Akademische Verlagsgesellschaft (1968).

Chemical sensitization may be carried out with addition of compounds of sulfur, selenium, tellurium and/or compounds of metals of the VIIIth secondary group of the periodic system (for example gold, platinum, palladium, iridium). Thiocyanate compounds, surface-active compounds, such as thioethers, heterocyclic nitrogen compounds (for example imidazoles, azaindenes) or even spectral sensitizers (described for example in F. Hamer "The Cyanine Dyes and Related Compounds", 1964, and in Ullmanns Encyclopadie der technischen Chemie, 4th Edition, Vol. 18, pages 431 et seq and Research Disclosure no. 17643, Section III) may also be added. Reduction sensitization with addition of reducing agents (tin(II) salts, amines, hydrazine derivatives, aminoboranes, silanes, formamidine sulfinic acid) may be carried out instead of or in addition to chemical sensitization by hydrogen, by a low pAg value (for example below 5) and/or a high pH value (for example above 8).

The photographic emulsions may contain compounds to prevent fogging or to stabilize the photographic function during production, storage and photographic processing.

In addition to the compounds according to the invention, suitable compounds of this type are azaindenes, preferably tetra- and pentaazindenes, particularly those substituted by hydroxyl or amino groups. Compounds such as these are described, for example, by Birr, Z. Wiss. Phot. 47 (1952) pages 2 to 58. Other suitable antifogging agents are salts of metals, such as mercury or cadmium, aromatic sulfonic acids or sulfinic acids, such as benzenesulfinic acid, or nitrogen-containing heterocycles, such as nitrobenzimidazole, nitroindazole, optionally substituted benztriazoles or benzthiazolium salts. Heterocycles containing mercapto groups are particularly suitable, examples of such compounds being mercaptobenzthiazoles, mercaptobenzimidazoles, mercaptotetrazoles, mercaptothiadiazoles, mercaptopyrimidines; these mercaptoazoles may even contain a water-solubilizing group, for example a carboxyl group or sulfo group. Other suitable compounds are published in Research Disclosure no. 17643 (1978), Section VI.

The stabilizers may be added to the silver halide emulsions before, during or after ripening. The compounds may of course also be added to other photographic layers associated with a silver halide layer.

Mixtures of two or more of the compounds mentioned may also be used.

The photographic emulsion layers or other hydrophilic colloid layers of the photosensitive material produced in accordance with the invention may contain surface-active agents for various purposes, such as coating aids, for preventing electrical charging, for improving surface slip, for emulsifying the dispersion, for preventing adhesion and for improving the photographic characteristics (for example development acceleration, high contrast, sensitization, etc.). In addition to natural surface-active compounds, for example saponin, synthetic surface-active compounds (surfactants) are mainly used: nonionic surfactants, for example alkylene oxide compounds, glycerol compounds or glycidol compounds; cationic surfactants, for example higher alkylamines, quaternary ammonium salts, pyridine compounds and other heterocyclic compounds, sulfonium compounds or phosphonium compounds; anionic surfactants containing an acid group, for example a carboxylic acid, sulfonic acid, phosphoric acid, sulfuric acid ester or phosphoric acid ester group; ampholytic surfactants, for example amino acid and aminosulfonic acid compounds and also sulfur or phosphoric acid esters of an aminoalcohol.

The photographic emulsions may be spectrally sensitized using methine dyes or other dyes. Particularly suitable dyes are cyanine dyes, merocyanine dyes and complex merocyanine dyes.

A review of the polymethine dyes suitable as spectral sensitizers, suitable combinations thereof and supersensitizing combinations thereof can be found in Research Disclosure 17643/1978, Section IV.

The following dyes (in order of spectral regions) are particularly suitable:

1. as red sensitizers 9-ethylcarbocyanines with benzthiazole, benzselenoazole or naphthothiazole as basic terminal groups, which may be substituted in the 5- and/or 6-position by halogen, methyl, methoxy, carbalkoxy, aryl, and also 9-ethyl naphthoxathia- or selenocarbocyanines and 9-ethyl naphthothiaoxa- and benzimidazocarbocyanines, providing the dye contains at least one sulfoalkyl group at the heterocyclic nitrogen;

2 as green sensitizers 9-ethylcarbocyanines with benzoxazole, naphthoxazole or a benzoxazole and a benzthiazole as basic terminal groups and also benzimidazocarbocyanines which may also be further substituted and must also contain at least one sulfoalkyl group at the heterocyclic nitrogen;

3. as blue sensitizers symmetrical or asymmetrical benzimidazo-, oxa-, thia- or selenacyanines containing at least one sulfoalkyl group at the heterocyclic nitrogen and, optionally, other substituents at the aromatic nucleus and also apomerocyanines containing a thiocyanine group.

The following red sensitizers RS, green sensitizers GS and blue sensitizers BS, which may be used individually or in combination with one another, for example RS 1 and RS 2 and also GS 1 and GS 2, are mentioned as examples, particularly for negative and reversal film.

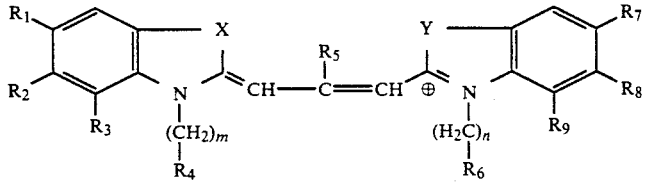

RS 1: $R_1$, $R_3$, $R_7$, $R_9$=H; $R_2$, $R_8$=Cl; $R_4=SO_3^{\ominus}\oplus NH(C_2H_5)_3$; $R_5=C_2H_5$; $R_6=SO_3^{\ominus}$; m, n=3; X, Y=S;

RS 2: $R_1$, $R_3$, $R_9$=H; $R_2$=Phenyl; $R_4$=

$$-\underset{\underset{CH_3}{|}}{CH}-SO_3^{\ominus}K^{\oplus};$$

$R_5=C_2H_5$; $R_6=SO_3^{\ominus}$; $R_7$, $R_8$=—$OCH_3$; m=2; n=3; X=O; Y=S;

RS 3: $R_1$, $R_9$=H; $R_2$, $R_3$ together —CH=CH—CH=CH—; $R_4=SO_3^{\ominus}Na^{\oplus}$; $R_5=C_2H_5$; $R_6=SO_3^{\ominus}$; $R_7$, $R_8$=Cl; m, n=3; X=S; Y=N—$C_2H_5$;

RS 4: $R_1=OCH_3$; $R_2$, $R_8=CH_3$; $R_3$, $R_4$, $R_7$, $R_9$=H; $R_5=C_2H_5$; $R_6=SO_3^{\ominus}$; m=2; n=4; X=S; Y=Se;

RS 5: $R_1$, $R_7$=H; $R_2$, $R_3$ and $R_8$, $R_9$ together —CH=CH—CH=CH—; $R_4=SO_3^{\ominus}\oplus NH(C_2H_5)_3$; $R_5=C_2H_5$; $R_6=SO_3^{\ominus}$; m=2; n=3; X, Y=S;

GS 1: $R_1$, $R_3$, $R_7$, $R_9$=H; $R_2$=Phenyl; $R_4$=

$$\underset{\underset{CH_3}{|}}{CH}-SO_3^{\ominus}\overset{\oplus}{N}H(C_2H_5)_3;$$

$R_5=C_2H_5$; $R_6=SO_3^{\ominus}$; $R_8$=Cl; m=2; n=3; X, Y=O;

GS 2: $R_1$, $R_2$, $R_7$, $R_8$=Cl; $R_3$, $R_5$, $R_6$, $R_9$=H; $R_4$=

$$-\underset{\underset{CH_3}{|}}{CH}-SO_3^{\ominus};$$

m, n=2; X, Y=N—$C_2H_5$;

GS 3: $R_1$, $R_7$=H; $R_2$, $R_3$ and $R_8$, $R_9$ together —CH=CH—CH=CH—; $R_4$=$SO_3^{\ominus}Na^{\oplus}$; $R_5$=$C_2H_5$; $R_6$=$SO_3^{\ominus}$; m, n=3; X, Y=O;

GS 4; $R_1$, $R_3$, $R_4$, $R_7$, $R_8$, $R_9$=H; $R_2$=$OCH_3$; $R_5$=$C_2H_5$; $R_6$=$SO_3^{\ominus}$; m=2; n=4; X=O; Y=S;

BS 1:

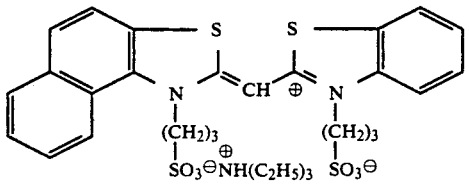

BS 2: Cl

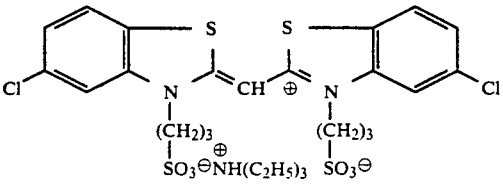

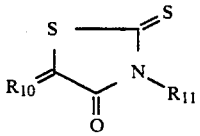

BS 3: $R_{10}$ =

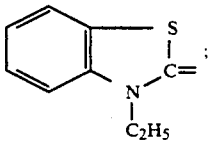

; $R_{11}$ = —$CH_2$—COOH

BS 4: $R_{10}$ =

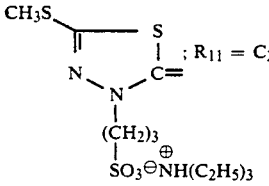

; $R_{11}$ = $C_2H_5$

BS 5: $R_{10}$ =

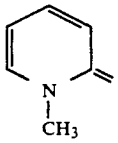

; $R_{11}$ = $C_2H_5$

There is no need for sensitizers where the natural sensitivity of the silver halide is sufficient for a certain spectral region, for example the blue sensitivity of silver bromides.

Non-diffusing monomeric or polymeric color couplers are associated with the differently sensitized emulsion layers and may be arranged in the same layer or in an adjacent layer. Cyan couplers are normally associated with the red-sensitive layers, magenta couplers with the green-sensitive layers and yellow couplers with the blue-sensitive layers.

Color couplers for producing the cyan component dye image are generally couplers of the phenol or α-naphthol type, of which the following are suitable examples:

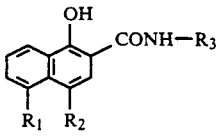

BG 1: $R_1$ = H; $R_2$ = H; $R_3$ = —$(CH_2)_3$—O—

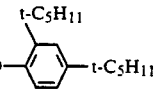

BG 2: $R_1$=—NHCOOCH$_2$—CH$(CH_3)_2$; $R_2$=H; $R_3$=—$(CH_2)_3$—$OC_{12}H_{25}$

BG 3: $R_1$=H; $R_2$=—$OCH_2$—$CH_2$—$SO_2CH_3$; $R_3$=$C_{16}H_{33}$

BG 4: $R_1$=H; $R_2$=—$OCH_2$—CONH—$(CH_2)_2$—$OCH_3$;

$R_3$ = —$(CH_2)_4$—O—

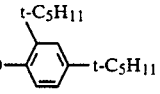

BG 5: $R_1$ = H; $R_2$ = H; $R_3$ = —$(CH_2)_4$—O—

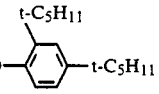

BG 6: $R_1$=H; $R_2$=H; $R_3$=

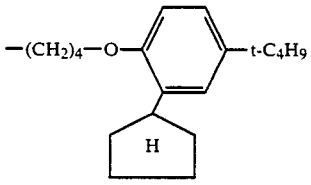

BG 7: $R_1$=H; $R_2$=Cl; $R_3$=—C $(C_2H_5)_2$—$(CH_2)_{20}$—$CH_3$

BG 8: $R_1$=H; $R_2$=—O—$CH_2$—$CH_2$—S—CH(COOH)—$C_{12}H_{25}$ $R_3$=Cyclohexyl

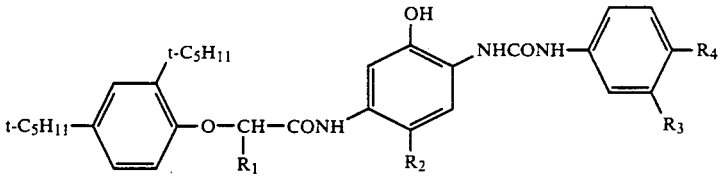

BG 9: $R_1$=$C_4H_9$; $R_2$=H; $R_3$=—CN; $R_4$=Cl

BG 10: $R_1$=$C_4H_9$; $R_2$=H; $R_3$=H; $R_4$=—$SO_2CHF_2$

BG 11: $R_1$=—$C_4H_9$; $R_2$=

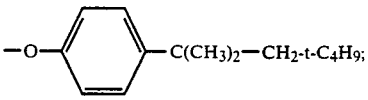

$R_3$=H; $R_4$=—CN BG 12: $R_1$=$C_2H_5$; $R_2$=H; $R_3$=H; $R_4$=—$SO_2CH_3$ BG 13: $R_1$=—$C_4H_9$; $R_2$=H; $R_3$=H; $R_4$=—$SO_2$—$C_4H_9$ BG 14: $R_1$=—$C_4H_9$; $R_2$=H; $R_3$=—CN; $R_4$=—CN

BG 15: $R_1$=—$C_4H_9$; $R_2$=H; $R_3$=H; $R_4$=—$SO_2$—$CH_2$—$CHF_2$

BG 16: $R_1$=—$C_2H_5$; $R_2$=H; $R_3$=H; $R_4$=—$SO_2CH_2$—CHF—$C_3H_7$

BG 17: $R_1$=—$C_4H_9$; $R_2$=H; $R_3$=H; $R_4$=F

BG 18: $R_1$=—$C_4H_9$; $R_2$=H; $R_3$=H; $R_4$=—$SO_2CH_3$

BG 19: $R_1$=—$C_4H_9$; $R_2$=H; $R_3$=H; $R_4$=—CN

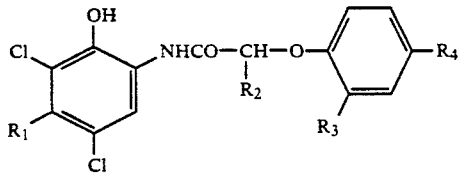

BG 20: $R_1$=—$CH_3$; $R_2$=—$C_2H_5$; $R_3$, $R_4$=—t—$C_5H_{11}$

BG 21: $R_1$=—$CH_3$; $R_2$=H; $R_3$, $R_4$=—t—$C_5H_{11}$

BG 22: $R_1$=—$C_2H_5$; $R_2$=—$C_2H_5$; $R_3$, $R_4$=—t—$C_5H_{11}$ BG 23: $R_1$=—$C_2H_5$; $R_2$=—$C_4H_9$; $R_3$, $R_4$=—t—$C_5H_{11}$

BG 24: $R_1$=—$C_2H_5$; $R_2$=—$C_4H_9$; $R_3$, $R_4$=—t—$C_4H_9$

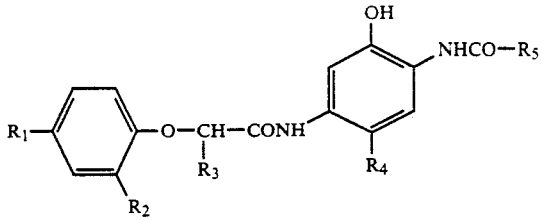

BG 25: $R_1$, $R_2$=—t—$C_5H_{11}$; $R_3$=—$C_4H_9$; $R_4$=H; $R_5$=—$C_3F_7$

BG 26: $R_1$=—$NHSO_2$—$C_4H_9$; $R_2$=H; $R_3$=—$C_{12}H_{25}$; $R_4$=Cl; $R_5$=phenyl BG 27: $R_1$, $R_2$=—t—$C_5H_{11}$; $R_2$=Cl, $R_3$=—$CH(CH_3)_2$; $R_4$=Cl; $R_5$=pentafluorophenyl BG 28: $R_1$=—t—$C_5H_{11}$; $R_2$=Cl; $R_3$=—$C_6H_{13}$; $R_4$=Cl; $R_5$=—2—chlorophenyl Color couplers for producing the magenta component dye image are generally couplers of the 5-pyrazolone type, the indazolone type or the pyrazoloazole type, of which suitable examples are:

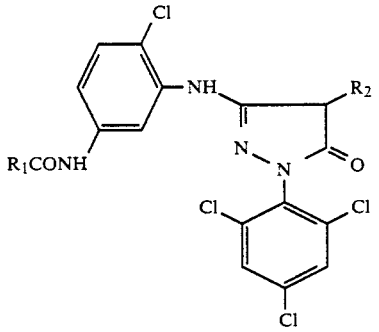

PP 1: $R_1$ = —O—CH(CH$_3$)—CH$_2$—O— t-$C_4H_9$; $R_2$ = H

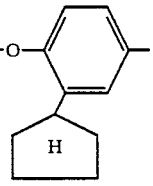

PP 2: $R_1$ = —CH($C_{12}H_{25}$)—O— OH; $R_2$ = H

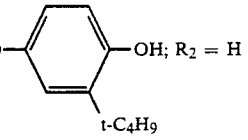

PP 3: $R_1$ = —$C_{13}H_{27}$; $R_2$ = H

PP 4: $R_1$ = —O—$C_{16}H_{33}$; $R_2$ = H

PP 5: $R_1$ = —$C_{13}H_{27}$; $R_2$ = —S—

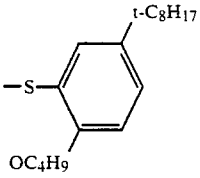

-continued
PP 6: $R_1$ = 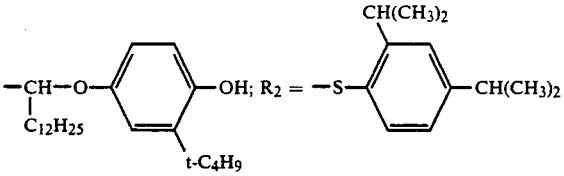
PP 7: $R_1 = -C_9H_{19}$; $R_2$ = 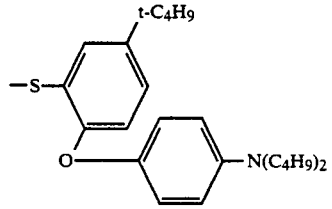
PP 8: $R_1$ = 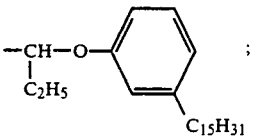 ; $R_2$ = 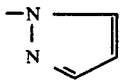
PP 9: 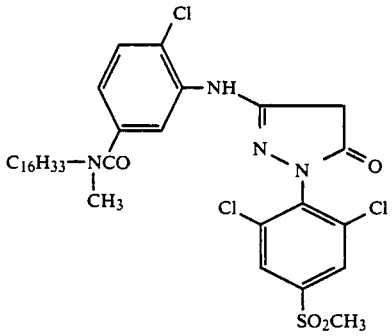
PP 10: 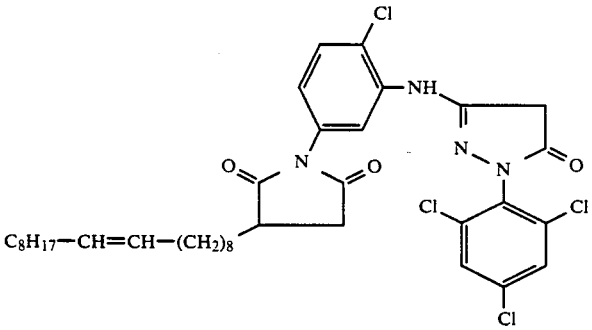
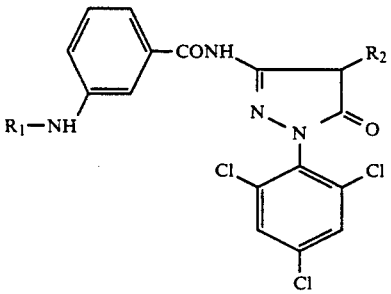
PP 11: $R_1$ = 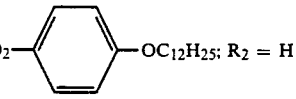 ; $R_2$ = H -continued
PP 12: $R_1$ = —CO—$CH_2$—O— 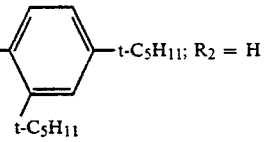 —t-$C_5H_{11}$; $R_2$ = H
PP 13: $R_1$ = —CO—CH(—$C_2H_5$)—O— 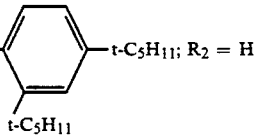 —t-$C_5H_{11}$; $R_2$ = H
PP 14: $R_1$ = —CO—CH(—$C_2H_5$)—O— 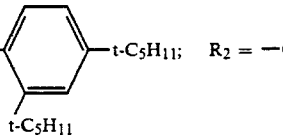 —t-$C_5H_{11}$; $R_2$ = —O— 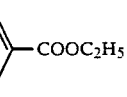 —$COOC_2H_5$
PP 15: $C_{17}H_{35}CONH$ 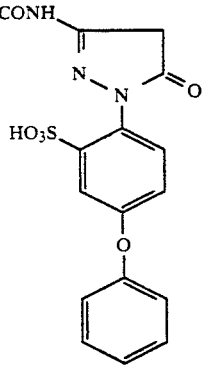
PP 16: 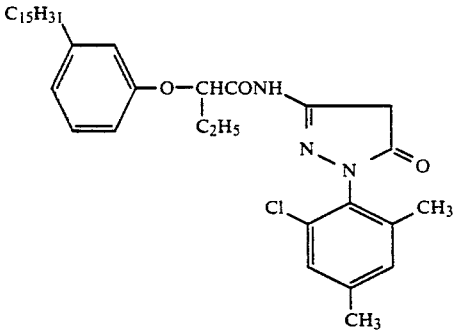
PP 17: t-$C_4H_9CONH$ 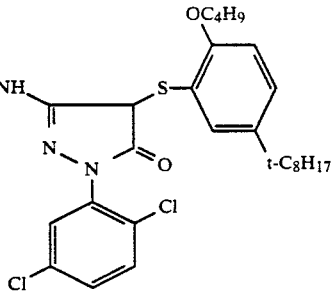
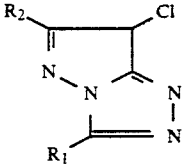

-continued

PP 18: $R_1$ = 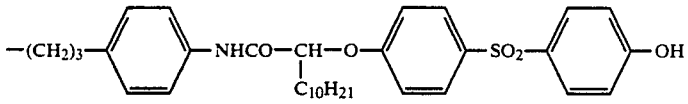

$R_2 = -CH_3$

PP 19: $R_1$ = 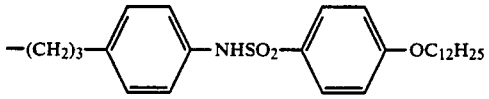

$R_2 = -CH_3$

PP 20: $R_1$ = 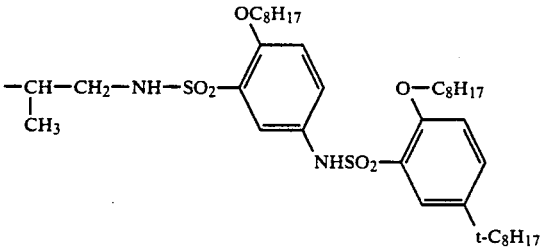

$R_2$ = -t-$C_4H_9$

PP 21: $R_1$ = 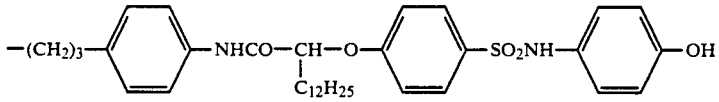

$R_2 = -CH_3$

PP 22: 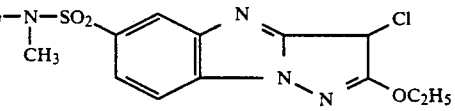

Color couplers for producing the yellow component dye image are generally couplers containing an open-chain ketomethylene group, more especially couplers of the α-acyl acetamide type, of which suitable examples are α-benzoyl acetanilide couplers and α-pivaloyl acetanilide couplers corresponding to the following formulae:

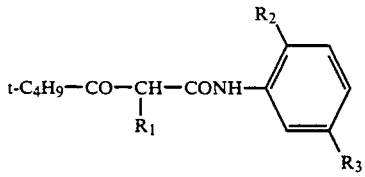

GB 1: $R_1$ = 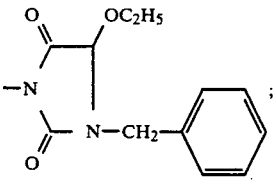 ; $R_2$ = Cl; $R_3$ = 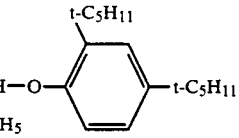

GB 2: $R_1$ = 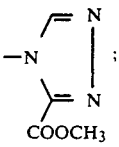 ; $R_2 = -OC_{16}H_{33}$; $R_3 = -SO_2NHCH_3$

GB 3: $R_1$ = 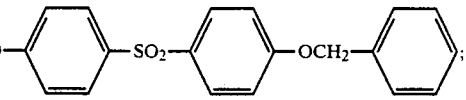 ; $R_2$ = Cl

-continued
$R_3 = -NHSO_2-C_{16}H_{33}$
GB 4: $R_1 =$ 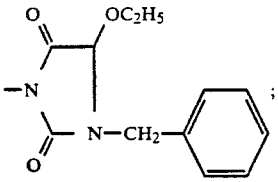 ; $R_2 = Cl$; $R_3 = -COOC_{12}H_{25}$
GB 5: $R_1 =$ 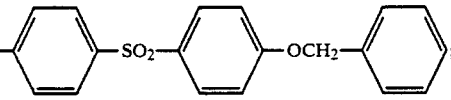 ; $R_2 = Cl$
$R_3 =$ 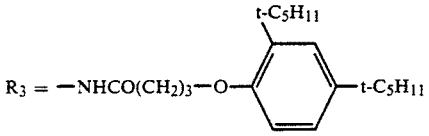
GB 6: $R_1 =$ 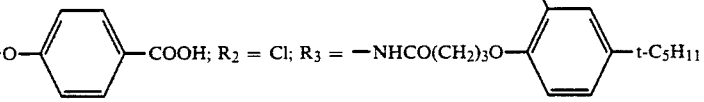 ; $R_2 = Cl$; $R_3 =$ 
GB 7: $R_1 =$ 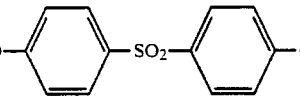 ; $R_2 = Cl$; $R_3 = -NHSO_2C_{16}H_{33}$
GB 8: $R_1 =$ 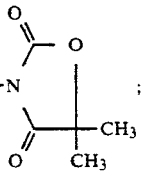 ; $R_2 = Cl$; $R_3 =$ 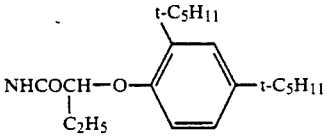
GB 9: $R_1 =$ 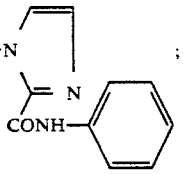 ; $R_2 = OC_{16}H_{33}$; $R_3 = -SO_2NHCOC_2H_5$
GB 10: $R_1 =$ 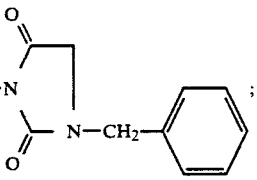 ; $R_2 = Cl$; $R_3 =$ 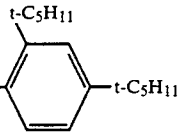
GB 11: $R_1 =$ 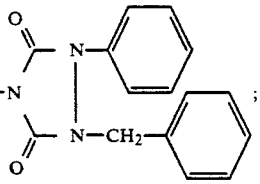 ; $R_2 = Cl$; $R_3 = -COOCH(C_4H_9)-COOC_{12}H_{25}$ -continued
GB 12: $R_1$ = 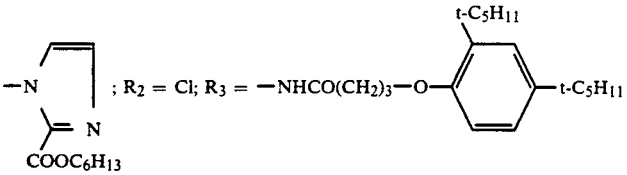 ; $R_2$ = Cl; $R_3$ = $-NHCO(CH_2)_3-O-$ (t-$C_5H_{11}$, t-$C_5H_{11}$)
GB 13: $R_1$ = 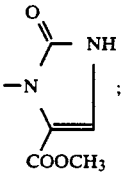 ; $R_2$ = $-OC_{16}H_{33}$; $R_3$ = $-SO_2NHCH_3$
GB 14: $R_1$ = 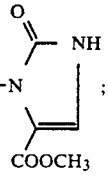 ; $R_2$ = Cl
$R_3$ = $-NHCO(CH_2)_3-O-$ (t-$C_5H_{11}$, t-$C_5H_{11}$)
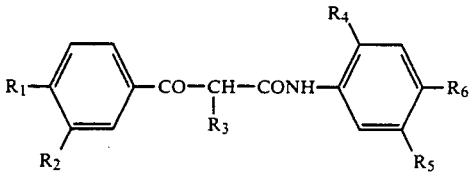
GB 15: $R_1$, $R_3$, $R_5$, $R_6$ = H; $R_4$ = $-OCH_3$; $R_2$ = $-NH-CO-CH(C_2H_5)-O-$ (t-$C_5H_{11}$, t-$C_5H_{11}$)
GB 16: $R_2$, $R_6$ = H; $R_1$ = $-OC_{16}H_{33}$; $R_4$, $R_5$ = $-OCH_3$; $R_3$ = 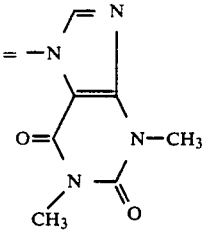
GB 17: $R_2$, $R_6$ = H; $R_1$ = $-OCH_3$, $R_4$ = Cl; $R_5$ = $-COOC_{12}H_{25}$; $R_3$ = 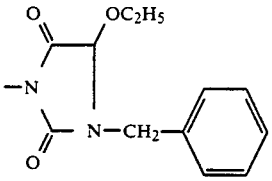

-continued

GB 18: $R_2$ = H; $R_1$ = $-OC_{16}H_{33}$; $R_4$ = Cl; $R_5$, $R_6$ = $-OCH_3$; $R_3$ = 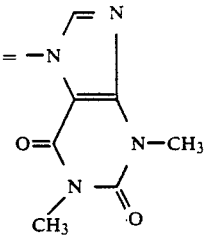

GB 19: $R_2$, $R_5$ = H; $R_1$ = $-OC_{16}H_{33}$; $R_4$ = $-OCH_3$; $R_3$ = 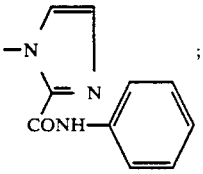 ; $R_6$ = $-SO_2N(CH_3)_2$ GB 20: $R_2$, $R_6$ = H; $R_1$, $R_4$ = $-OCH_3$; $R_3$ = 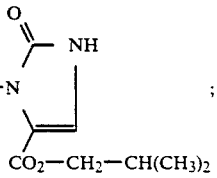 ; $R_5$ = 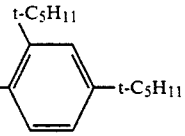

GB 21: 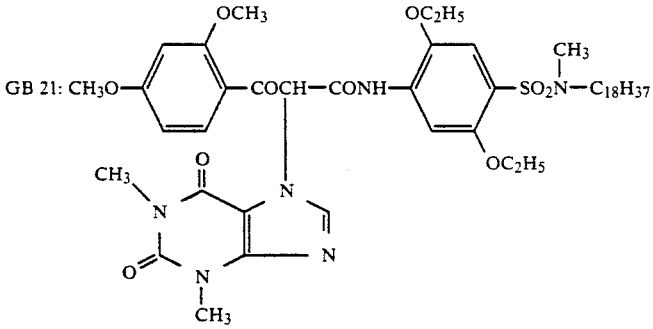

The color couplers may be 4-equivalent couplers and also 2-equivalent couplers. 2-Equivalent couplers are derived from the 4-equivalent couplers in that they contain in the coupling position a substituent which is eliminated during the coupling reaction. 2-Equivalent couplers include both those which are substantially colorless and also those which have a strong color of their own which either disappears during the color coupling reaction or is replaced by the color of the image dye produced (mask couplers) and white couplers which give substantially colorless products on reaction with color developer oxidation products. 2-Equivalent couplers also include couplers which, in the coupling position, contain a releasable group which is released on reaction with color developer oxidation products and develops a certain desired photographic activity, for example as a development inhibitor or accelerator, either directly or after one or more other groups have been released from the group initially released (for example DE-A-27 03 145, DE-A-28 55 697, DE-A-31 05 026, DE-A-33 19 428). Examples of 2-equivalent couplers such as these are the known DIR couplers and also DAR and FAR couplers.

Examples of white couplers are

W1

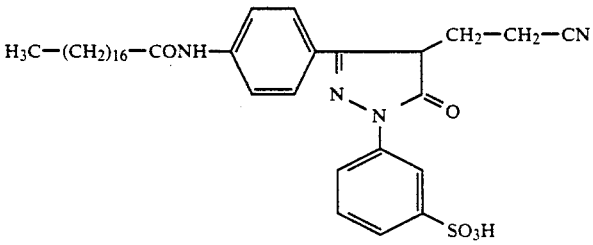

-continued
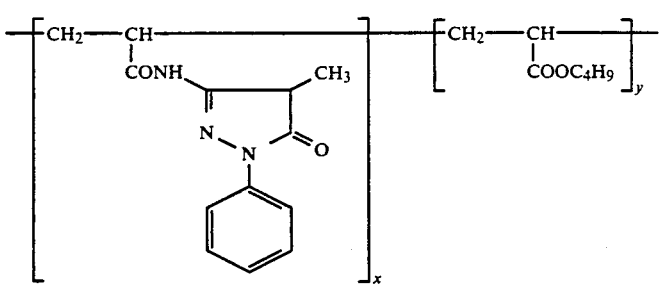
W2
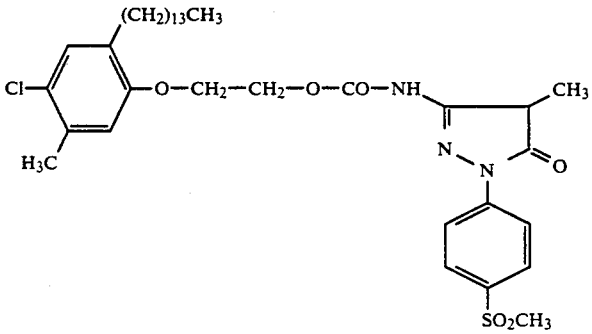
W3
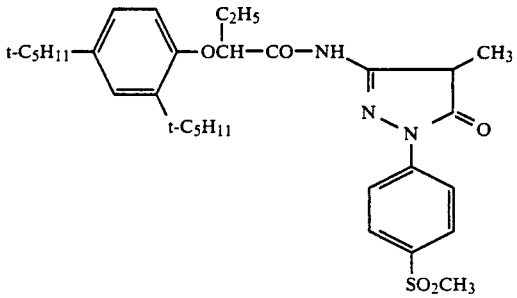
W4
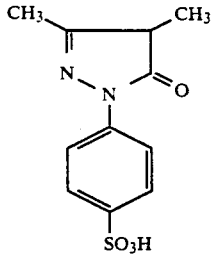
W5
Examples of mask couplers are:
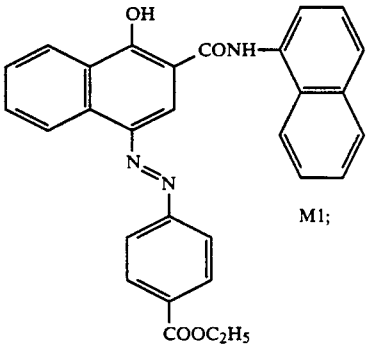
M1;
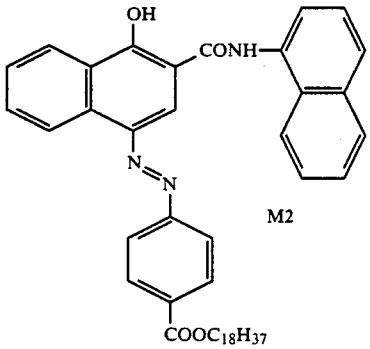
M2

-continued
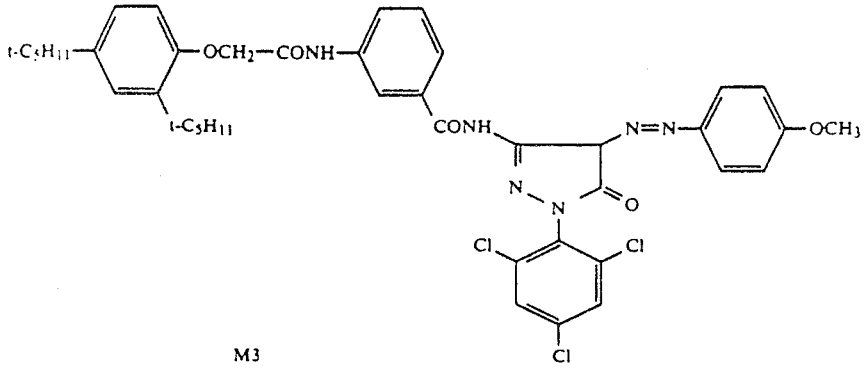
M3
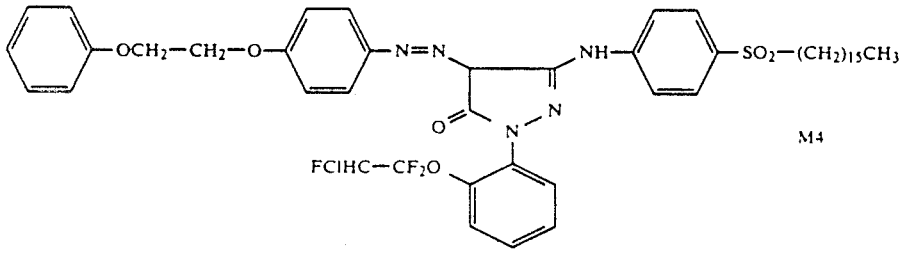
M4
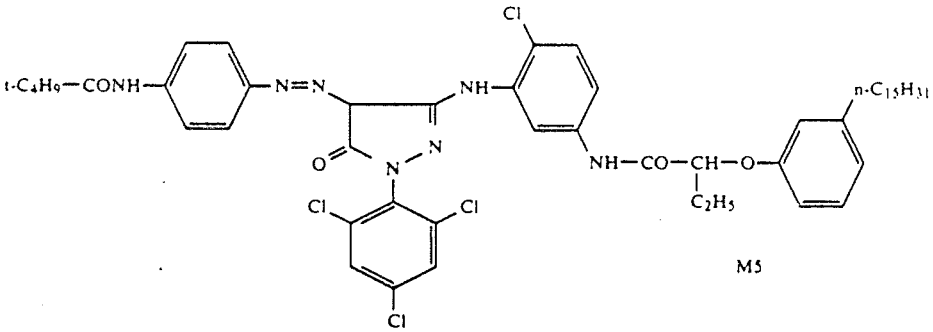
M5
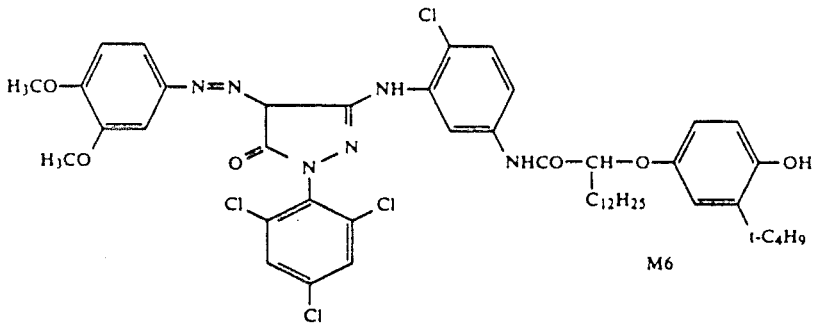
M6
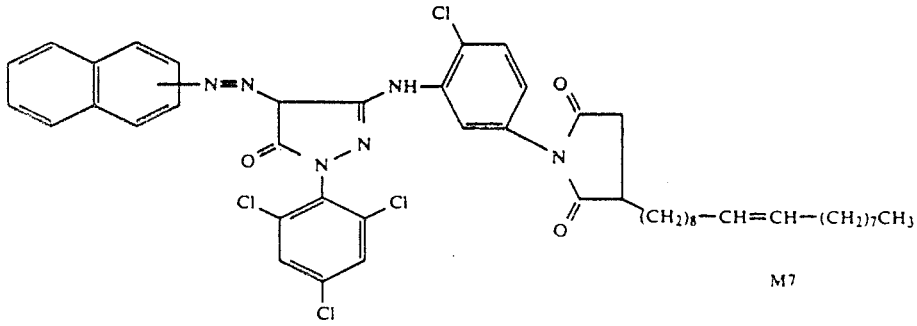
M7

-continued
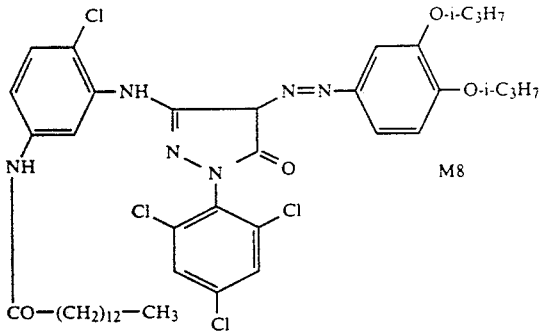
M8
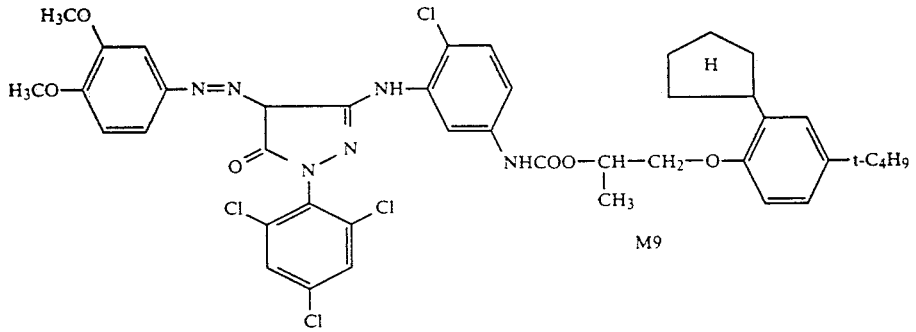
M9
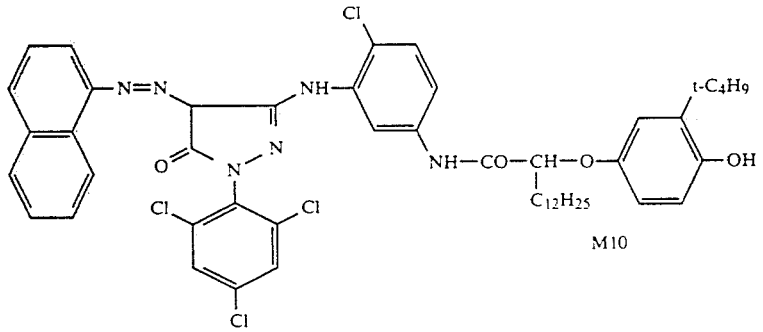
M10
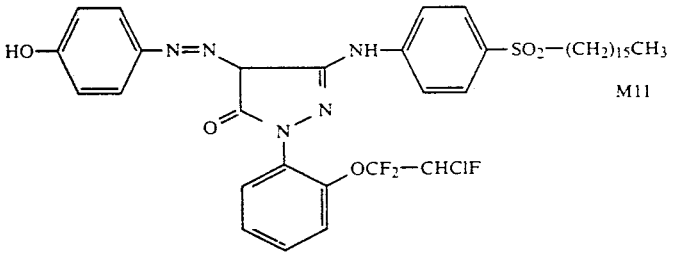
M11
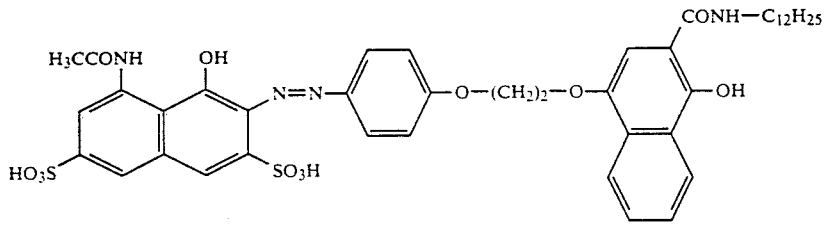
M12

-continued

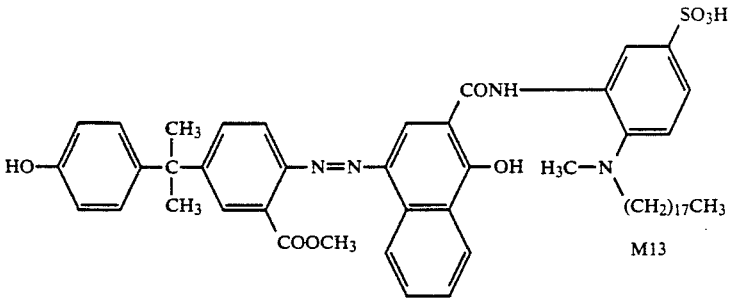

M13

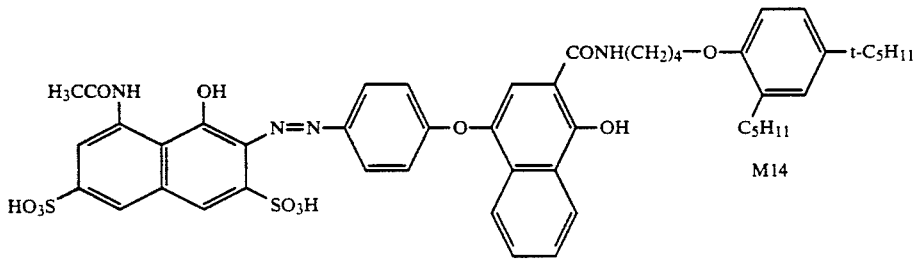

M14

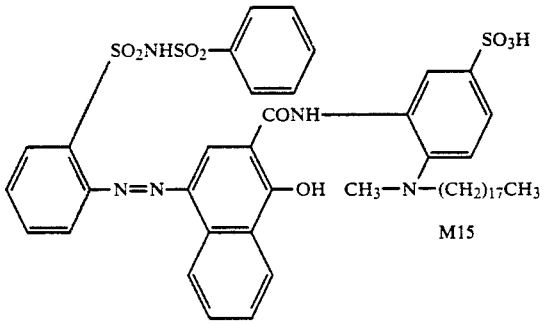

M15

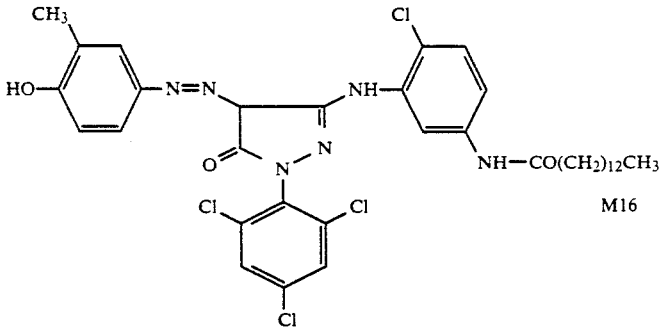

M16

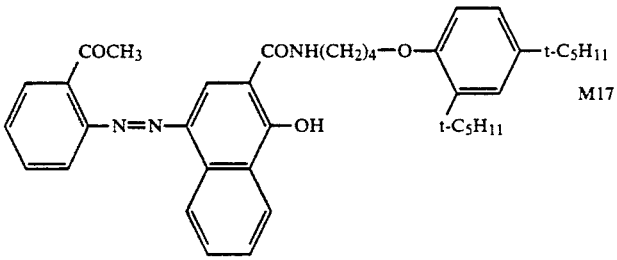

M17

DIR couplers containing development inhibitors of the azole type, for example triazoles and benzotriazoles, are described in DE-A-24 14 006, 26 10 546, 26 59 417, 27 54 281, 27 26 180, 36 26 219, 36 30 564, 36 36 824, 36 44 416 and 28 42 063. Further advantages in regard to color reproduction, i.e. color separation and color purity, and in regard to detail reproduction, i.e. sharpness and graininess, can be obtained with DIR couplers which, for example, do not release the development inhibitor as the direct result of coupling with an oxidized color developer, but only after a further reaction, for example with a timing group. Examples of DIR couplers such as these can be found in DE-A-28 55 697, 32 99 671, 38 18 231, 35 18 797, in EP-A-157 146 and 204 175, in U.S. Pat. Nos. 4,146,396 and 4,438,393 and in GB-A-2,072,363.

DIR couplers releasing a development inhibitor which is decomposed in the developer bath to photographically substantially inactive products are described, for example, in DE-A-3 209 486 and in EP-A-167 168 and 219 713. Problem-free development and stable processing are achieved by this measure.

Where DIR couplers, particularly those releasing a readily diffusible development inhibitor, are used, improvements in color reproduction, for example a more differentiated color reproduction, can be obtained by suitable measures during optical sensitization, as described for example in EP-A-115 304, 167 173, GB-A-2,165,058, DE-A-37 00 419 and U.S. Pat. No. 4,707,436.

In a multilayer photographic material, the DIR couplers may be added to various layers, including for example even non-photosensitive layers or intermediate layers. However, they are preferably added to the photosensitive silver halide emulsion layers, the characteristic properties of the silver halide emulsion, for example its iodide content, the structure of the silver halide grains or their grain size distribution, influencing the photographic properties obtained. The effect of the inhibitors released may be limited, for example by the incorporation of an inhibitor-trapping layer according to DE-A-24 31 223. For reasons of reactivity or stability, it may be of advantage to use a DIR coupler which, in the particular layer into which it is introduced, forms a color differing from the color to be produced in that layer during the coupling reaction.

To increase sensitivity, contrast and maximum density, it is possible to use above all DAR or FAR couplers which release a development accelerator or a fogging agent. Compounds of this type are described, for example, in DE-A-25 34 466, 32 09 110, 33 33 355, 34 10 616, 34 29 545, 34 41 823, in EP-A-89 834, 110 511, 118 087, 147 765 and in U.S. Pat. No. 4,618,572 and 4,656,123.

An example of the use of BAR (bleach accelerator releasing) couplers can be found in EP-A-193 389.

It can be of advantage to modify the effect of a photographically active group released from the coupler by an intermolecular reaction between this group after its release and another group in accordance with DE-A-35 06 805.

The following are examples of DIR couplers:

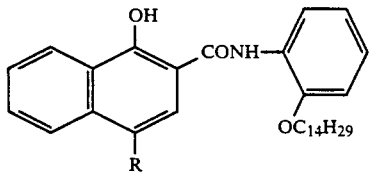

DIR 1

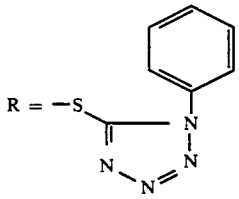

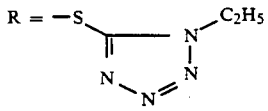

DIR 2

DIR 3

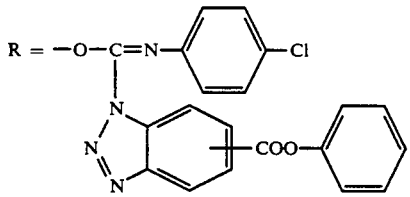

DIR 4

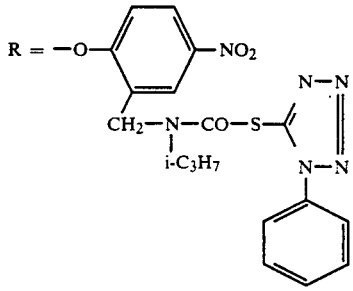

-continued
DIR 5
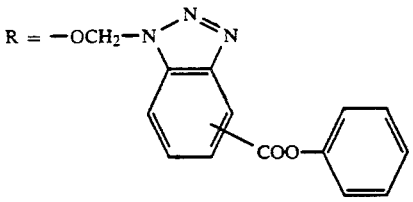
DIR 6
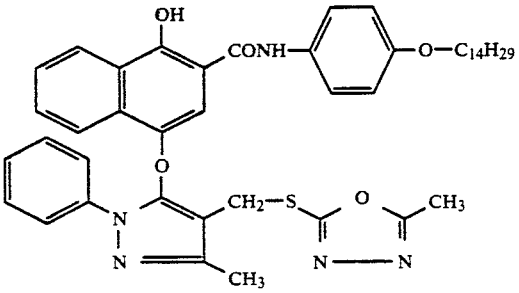
DIR 7
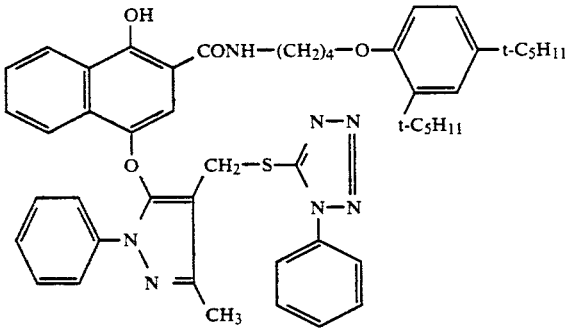
DIR 8
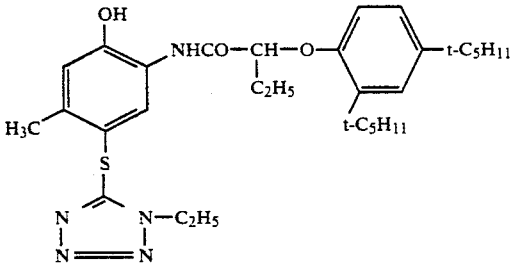
DIR 9
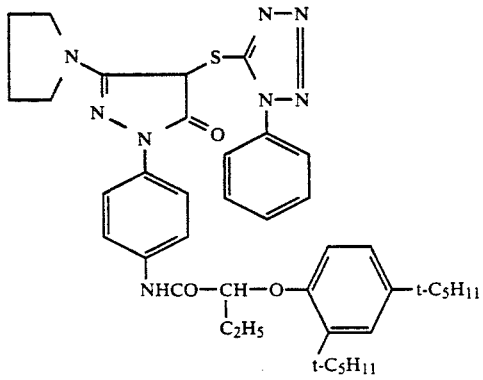

-continued
DIR 10
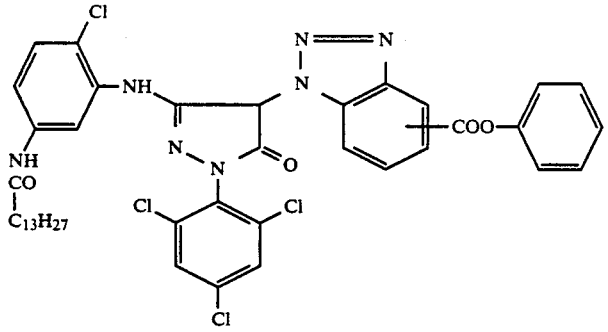
DIR 11
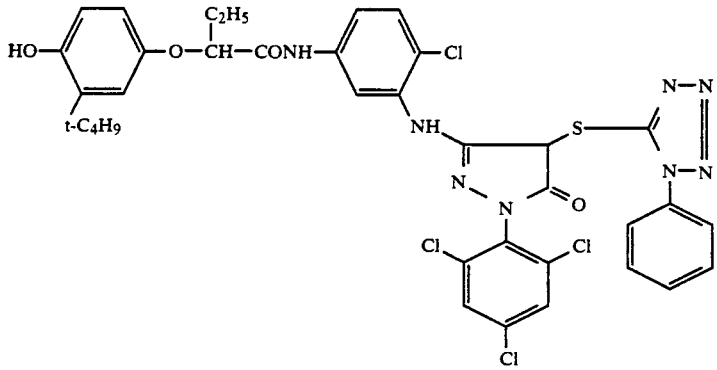
DIR 12
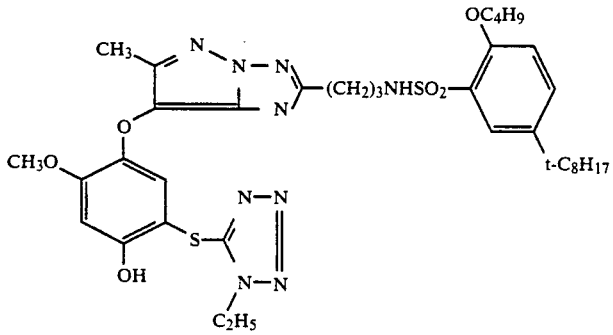
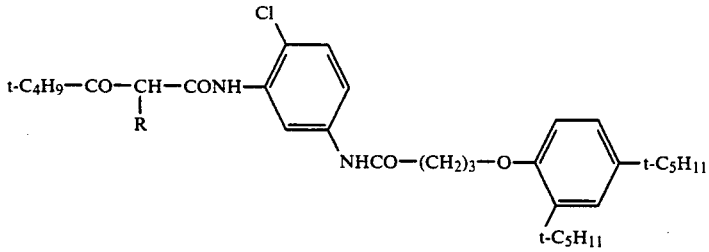
DIR 13
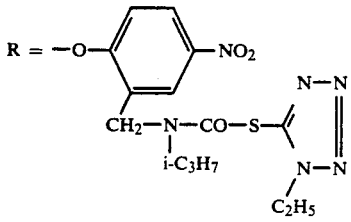
DIR 14
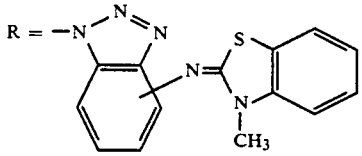

-continued
DIR 15
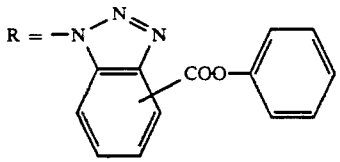
DIR 16
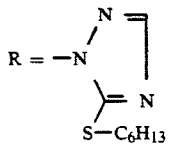
DIR 17
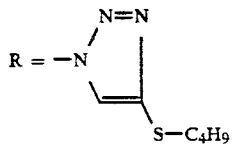
DIR 18
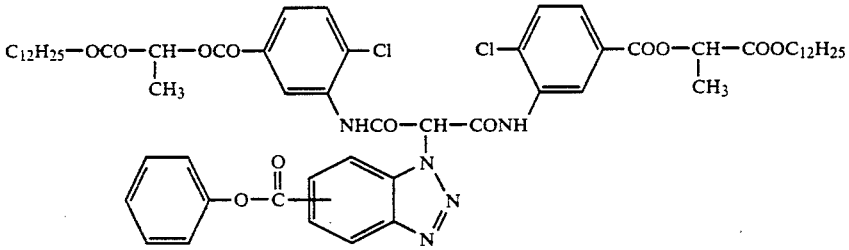
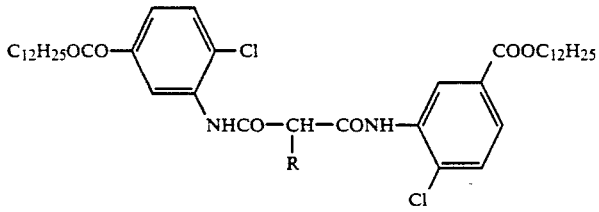
DIR 19
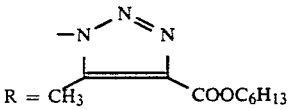
DIR 20
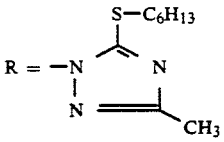
DIR 21
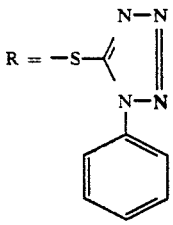

-continued
DIR 22
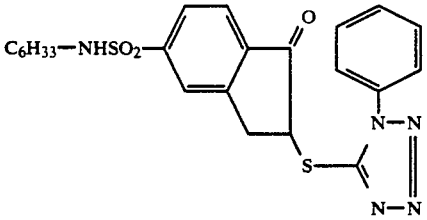
DIR 23
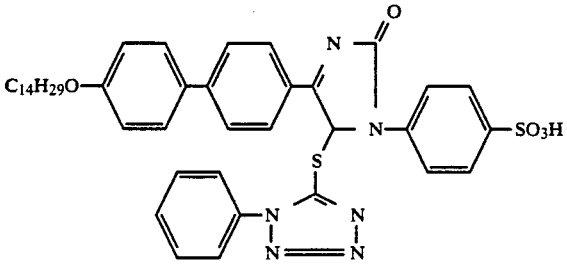
DIR 24
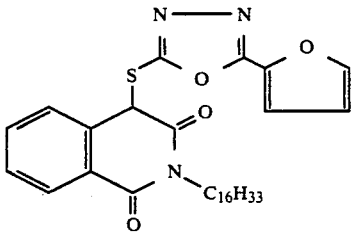
The following are examples of DAR couplers:
DAR 1
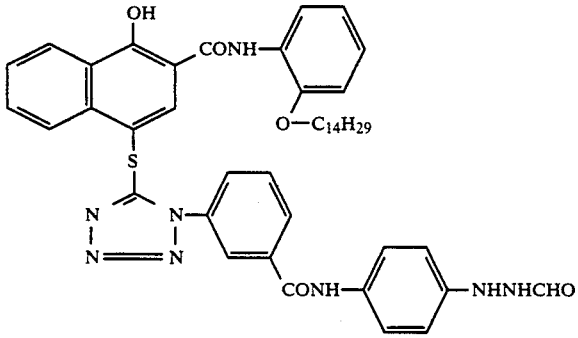
DAR 2
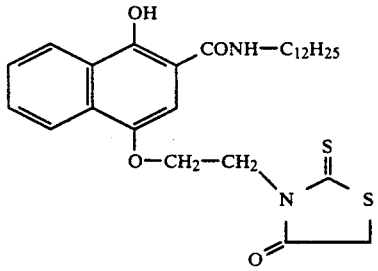

-continued

DAR 3

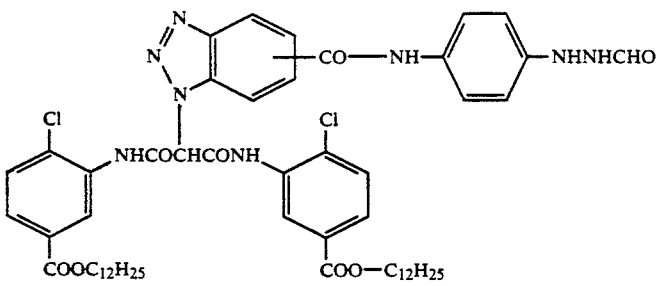

Since, in the case of DIR, DAR and FAR couplers, the activity of the group released during the coupling reaction is largely desirable with less importance being attributed to the dye-producing properties of these couplers, DIR, DAR and FAR couplers which give substantially colorless products during the coupling reaction are also suitable (DE-A-15 47 640).

The releasable group may also be a ballast group, so that coupling products which are diffusible or which at least show slight or limited mobility are obtained in the reaction with color developer oxidation products (U.S. Pat. No. 4,420,556).

The material may also contain compounds different from couplers which may release, for example, a development inhibitor, a development accelerator, a bleach accelerator, a developer, a silver halide solvent, a fogging agent or an anti-fogging agent, for example so-called DIR hydroquinones and other compounds of the type described, for example, in U.S. Pat. Nos. 4,636,546, 4,345,024, 4,684,604 and in DE-A-31 45 640, 25 15 213, 24 47 079 and in EP-A-198 438. These compounds perform the same function as the DIR, DAR or FAR couplers except that they do not form coupling products.

High molecular weight couplers are described, for example, in DE-C-1 297 417, DE-A-24 07 569, DE-A-31 48 125, DE-A-32 17 200, DE-A-33 20 079, DE-A-33 24 932, DE-A-33 31 743, DE-A-33 40 376, EP-0-27 284, U.S. Pat. No. 4,080,211. The high molecular weight color couplers are generally produced by polymerization of ethylenically unsaturated monomeric color couplers. However, they may also be obtained by polyaddition or polycondensation.

The couplers or other compounds may be incorporated in silver halide emulsion layers by initially preparing a solution, a dispersion or an emulsion of the particular compound and then adding it to the casting solution for the particular layer. The choice of a suitable solvent or dispersant depends upon the particular solubility of the compound.

Methods for introducing compounds substantially insoluble in water by grinding processes are described, for example, in DE-A-26 09 741 and DE-A-26 09 742.

Hydrophobic compounds may also be introduced into the casting solution using high-boiling solvents, so-called oil formers. Corresponding methods are described, for example in U.S. Pat. No. 2,322,027, U.S. Pat. No. 2,801,170, U.S. Pat. No. 2,801,171 and EP-A-0 043 037.

Instead of using high-boiling solvents, it is also possible to use oligomers or polymers, so-called polymeric oil formers.

The compounds may also be introduced into the casting solution in the form of charged latices, cf. for example DE-A-25 41 230, DE-A-25 41 274, DE-A-28 35 856, EP-A-0 014 921, EP-A-0 069 671, EP-A-0 130 115, U.S. Pat. No. 4,291,113.

Anionic water-soluble compounds (for example dyes) may also be incorporated in non-diffusing form with the aid of cationic polymers, so-called mordant polymers.

Suitable oil formers are, for example, phthalic acid alkyl esters, phosphonic acid esters, phosphoric acid esters, citric acid esters, benzoic acid esters, amides, fatty acid esters, trimesic acid esters, alcohols, phenols, aniline derivatives and hydrocarbons.

Examples of suitable oil formers are dibutyl phthalate, dicyclohexyl phthalate, di-2-ethyl hexyl phthalate, decyl phthalate, triphenyl phosphate, tricresyl phosphate, 2-ethyl hexyl diphenyl phosphate, tricyclohexyl phosphate, tri-2-ethyl hexyl phosphate, tridecyl phosphate, tributoxyethyl phosphate, trichloropropyl phosphate, di-2-ethyl hexyl phenyl phosphate, 2-ethyl hexyl benzoate, dodecyl benzoate, 2-ethyl hexyl-p-hydroxybenzoate, diethyl dodecaneamide, N-tetradecyl pyrrolidone, isostearyl alcohol, 2,4-di-tert.-amylphenol, dioctyl acetate, glycerol tributyrate, isostearyl lactate, trioctyl citrate, N,N-dibutyl-2-butoxy-5-tert.-octyl aniline, paraffin, dodecylbenzene and diisopropyl naphthalene.

Each of the differently sensitized photosensitive layers may consist of a single layer or may even comprise two or more partial silver halide emulsion layers (DE-C-1 121 470). Red-sensitive silver halide emulsion layers are often arranged nearer the layer support than green-sensitive silver halide emulsion layers which in turn are arranged nearer than blue-sensitive silver halide emulsion layers, a non-photosensitive yellow filter layer generally being present between green-sensitive layers and blue-sensitive layers.

Providing the natural sensitivity of the green-sensitive or red-sensitive layers is suitably low, it is possible to select other layer arrangements without the yellow filter layer, in which for example the blue-sensitive layers, then the red-sensitive layers and finally the green-sensitive layers follow one another on the support.

The non-photosensitive intermediate layers generally arranged between layers of different spectral sensitivity may contain agents to prevent unwanted diffusion of developer oxidation products from one photosensitive layer into another photosensitive layer with different spectral sensitization.

Suitable agents of the type in question, which are also known as scavengers or DOP trappers, are described in Research Disclosure 17 643 (December 1978), Chapter VII, 17 842/1979, pages 94–97 and 18 716/1979, page 650 and in EP-A-69 070, 98 072, 124 877, 125 522 and in U.S. Pat. No. 463,226.

The following are examples of particularly suitable compounds:

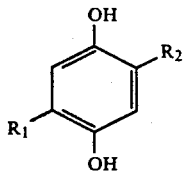

$R_1, R_2$ = -t-$C_8H_{17}$
-s-$C_{12}H_{25}$
-t-$C_6H_{13}$

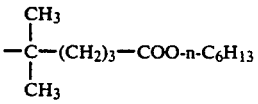

-s-$C_8H_{17}$
—$C_{15}H_{31}$

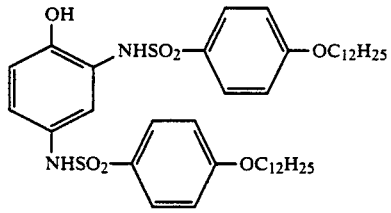

Where several partial layers of the same spectral sensitization are present, they may differ from one another in regard to their composition, particularly so far as the type and quantity of silver halide crystals is concerned. In general, the partial layer of higher sensitivity is arranged further from the support than the partial layer of lower sensitivity. Partial layers of the same spectral sensitization may be arranged adjacent one another or may be separated by other layers, for example by layers of different spectral sensitization. For example, all the high-sensitivity layers and all the low-sensitivity layers may be respectively combined to form a layer unit or layer pack (DE-A-19 58 709, DE-A-25 30 645, DE-A-26 22 922).

The photographic material may also contain UV absorbers, whiteners, spacers, filter dyes, formalin scavengers, light stabilizers, antioxidants, $D_{min}$ dyes, additives for improving dye, coupler and white stabilization and for reducing color fogging, plasticizers (latices), biocides and other additives.

UV-absorbing compounds are intended on the one hand to protect image dyes against fading under the effect of UV-rich daylight and, on the other hand, as filter dyes to absorb the UV component of daylight on exposure and thus to improve the color reproduction of a film. Compounds of different structure are normally used for the two functions. Examples are aryl-substituted benzotriazole compounds (U.S. Pat. No. 3,533,794), 4-thiazolidone compounds (U.S. Pat. Nos. 3,314,794 and 3,352,681), benzophenone compounds (JP-A-2784/71), cinnamic acid ester compounds (U.S. Pat. Nos. 3,705,805 and 3,707,375), butadiene compounds (U.S. Pat. No. 4,045,229) or benzoxazole compounds (U.S. Pat. No. 3,700,455).

The following are examples of particularly suitable compounds:

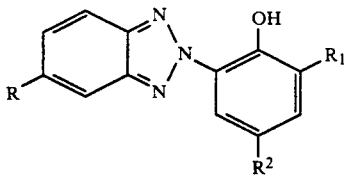

R, $R_1$=H; $R_2$=t—$C_4H_9$
R=H; $R_1$, $R_2$=t—$C_4H_9$
R=H; $R_1$, $R_2$=t—$C_5H_{11}$
R=H; $R_1$=s—$C_4H_9$; $R_2$=t—$C_4H_9$
R=Cl; $R_1$=t—$C_4H_9$; $R_2$=s—$C_4H_9$
R=Cl; $R_1$, $R_2$=t—$C_4H_9$
R=Cl; $R_1$=t—$C_4H_9$; $R_2$=—$CH_2$—$CH_2$—$COOC_8H_{17}$
R=H; R=i—$C_{12}H_{25}$; $R_2$=$CH_3$
R, $R_1$, $R_2$=t—$C_4H_9$

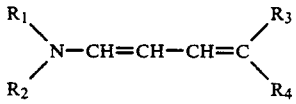

$R_1$, $R_2$=n—$C_6H_{13}$; $R_3$, $R_4$=CN
$R_1$, $R_2$=$C_2H_5$; $R_3$=

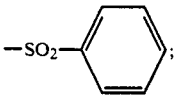

$R_4$=$COOC_8H_{17}$
$R_1$, R=$C_2H_5$; $R_3$=

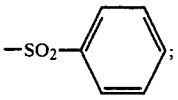

$R_4$=$COOC_{12}H_{25}$
$R_1$, $R_2$=$CH_2$—CH=$CH_2$; $R_3$, $R_4$=CN

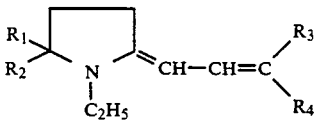

$R_1$, $R_2$=H; $R_3$=CN; $R_4$=CO—$NHC_{12}H_{25}$
$R_1$, $R_2$=$CH_3$; $R_3$=CN; $R_4$=CO—$NHC_{12}H_{25}$

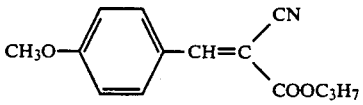

It is also possible to use UV-absorbing couplers (such as cyan couplers of the α-naphthol type) and UV-absorbing polymers. These UV absorbers may be fixed in a special layer by mordanting.

Filter dyes suitable for visible light include oxonol dyes, hemioxonol dyes, styryl dyes, merocyanine dyes, cyanine dyes and azo dyes. Of these dyes, oxonol dyes, hemioxonol dyes and merocyanine dyes may be used with particular advantage.

Suitable whiteners are described, for example, in Research Disclosure 17 643 (December 1978), Chapter V, in U.S. Pat. Nos. 2,632,701 and 3,269,840 and in GB-A-852,075 and 1,319,763.

Certain binder layers, particularly the layer furthest from the support, but occasionally intermediate layers as well, particularly where they are the layer furthest from the support during production, may contain inorganic or organic, photographically inert particles, for example as matting agents or as spacers (DE-A-33 31 542, DE-A-34 24 893, Research Disclosure 17 643, December 1978, Chapter XVI).

The mean particle diameter of the spacers is particularly in the range from 0.2 to 10 μm. The spacers are insoluble in water and may be insoluble or soluble in alkalis, the alkali-soluble spacers generally being removed from the photographic material in the alkaline development bath. Examples of suitable polymers are polymethyl methacrylate, copolymers of acrylic acid and methyl methacrylate and also hydroxypropyl methyl cellulose hexahydrophthalate.

The following are examples of suitable formalin scavengers:

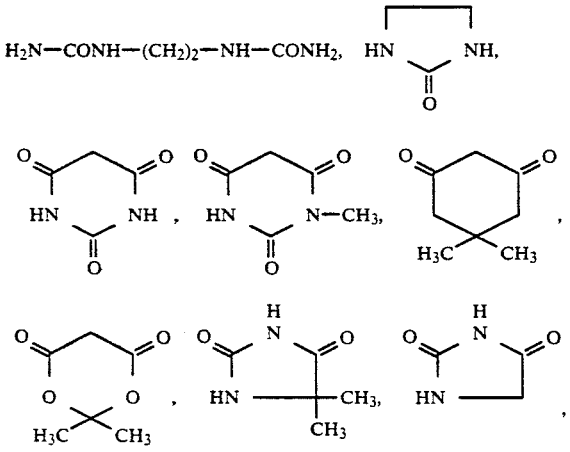

-continued

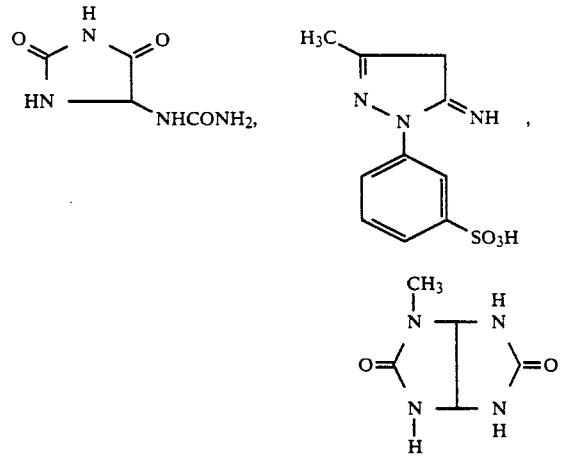

Additives for improving dye, coupler and white stability and for reducing color fogging (Research Disclosure 17 643/1978, Chapter VII) may belong to the following classes of chemical compounds: hydroquinones, 6-hydroxychromanes, 5-hydroxycoumaranes, spirochromanes, spiroindanes, p-alkoxyphenols, sterically hindered phenols, gallic acid derivatives, methylenedioxybenzenes, aminophenols, sterically hindered amines, derivatives containing esterified or etherified phenolic hydroxyl groups, metal complexes.

Compounds containing both a sterically hindered amine partial structure and also a sterically hindered phenol partial structure in one and the same molecule (U.S. Pat. No. 4,268,593) are particularly effective for preventing the impairment (deterioration or degradation) of yellow dye images as a result of the generation of heat, moisture and light. Spiroindanes (JP-A-159 644/81) and chromanes substituted by hydroquinone diethers or monethers (JP-A-89 83 5/80) are particularly effective for preventing the impairment (deterioration or degradation) of magenta-red dye images, particularly their impairment (deterioration or degradation) as a result of the effect of light.

The following are examples of particularly suitable compounds:

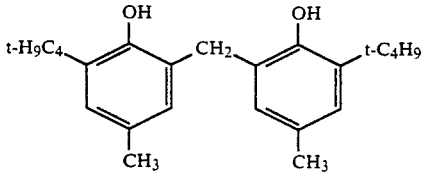

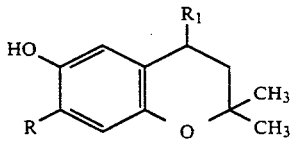

R = t-$C_8H_{17}$; $R_1$ = $CH_3$
R = n-$C_8H_{17}$; $R_1$ = i-$C_3H_7$

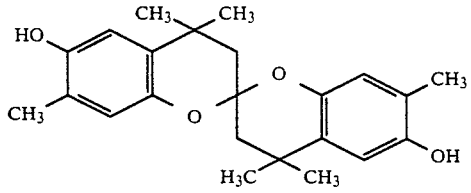

-continued

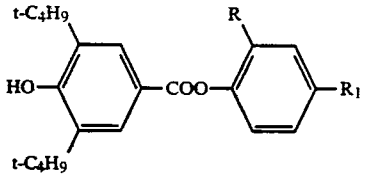

R, $R_1$ = t-$C_4H_9$
R, $R_1$ = t-$C_5H_{11}$

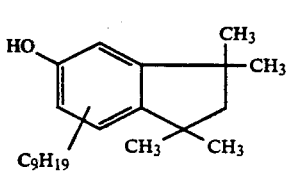

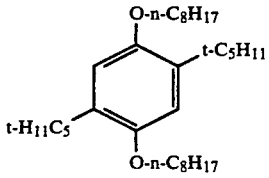

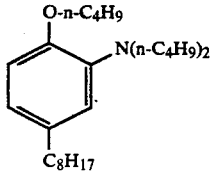

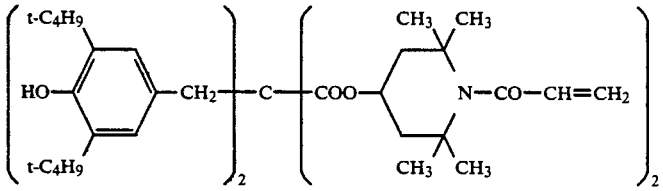

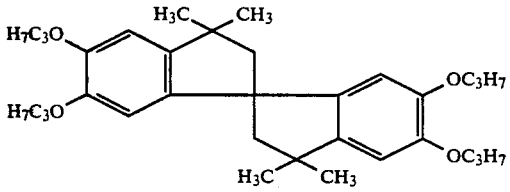

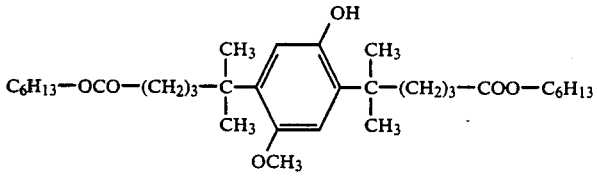

and the compounds mentioned as DOP trappers.

The layers of the photographic material may be hardened with the usual hardeners. Suitable hardeners are, for example, formaldehyde, glutaraldehyde and similar aldehyde compounds, diacetyl, cyclopentadione and similar ketone compounds, bis-(2-chloroethylurea), 2-hydroxy-4,6-dichloro-1,3,5-triazine and other compounds containing reactive halogen (U.S. Pat. No. 3,288,775, U.S. Pat. No. 2,732,303, GB-A-974,723 and GB-A-1,167,207), divinylsulfone compounds, 5-acetyl-1,3-diacryloyl hexahydro-1,3,5-triazine and other compounds containing a reactive olefin bond (U.S. Pat. No. 3,635,718, U.S. Pat. No. 3,232,763 and GB-A-994,869); N-hydroxymethyl phthalimide and other N-methylol compounds (U.S. Pat. No. 2,732,316 and U.S. Pat. No. 2,586,168); isocyanates (U.S. Pat. No. 3,103,437); aziridine compounds (U.S. Pat. No. 3,017,280 and U.S. Pat. No. 2,983,611); acid derivatives (U.S. Pat. No. 2,725,294 and U.S. Pat. No. 2,725,295); compounds of the carbodiimide type (U.S. Pat. No. 3,100,704); carbamoyl pyridinium salts (DE-A-22 25 230 and DE-A-24 39 551); carbamoyloxy pyridinium compounds (DE-A-24 08 814); compounds containing a phosphorus-halogen bond (JP-A-113 929/83); N-carbonyloximide compounds (JP-A-43353/81); N-sulfonyloximido compounds (U.S. Pat. No. 4,111,926), dihydroquinoline compounds (U.S. Pat. No. 4,013,468), 2-sulfonyloxy pyridinium salts (JP-A-110 762/81), formamidinium salts (EP-A-0 162 308), compounds containing two or more N-acyloximino groups (U.S. Pat. No. 4,052,373), epoxy compounds (U.S. Pat. No. 3,091,537), compounds of the isoxazole type (U.S. Pat. No. 3,321,313 and U.S. Pat. No. 3,543,292); halocarboxaldehydes, such as mucochloric acid; dioxane derivatives, such as dihydroxydioxane and dichlorodioxane; and inorganic hardeners, such as chrome alum and zirconium sulfate.

Hardening may be carried out in known manner by adding the hardener to the casting solution for the layer to be hardened or by overcoating the layer to be hardened with a layer containing a diffusible hardener.

Among the classes mentioned, there are slow-acting and fast-acting hardeners and also so-called instant hardeners which are particularly advantageous. Instant hardeners are understood to be compounds which crosslink suitable binders in such a way that, immediately after casting but at the latest 24 hours and, preferably 8 hours after casting, hardening has advanced to such an extent that there is no further change in the sensitometry and swelling of the layer combination as a result of the crosslinking reaction. By swelling is meant the difference between the wet layer thickness and dry layer thickness during aqueous processing of the film (Photogr Sci Eng. 8 (1964), 275; Photogr. Sci. Eng. (1972), 449).

These hardeners which react very quickly with gelatine are, for example, carbamoyl pyridinium salts which are capable of reacting with free carboxyl groups of the gelatine so that these groups react with free amino groups of the gelatine with formation of peptide bonds and crosslinking of the gelatine.

Suitable examples of instant hardeners are compounds corresponding to the following general formulae:

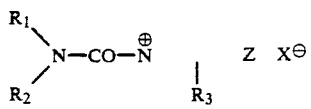

(a)

in which $R_1$ is alkyl, aryl or aralkyl, $R_2$ has the same meaning as R or represents alkylene, arylene, aralkylene or alkaralkylene, the second bond being attached to a group corresponding to formula

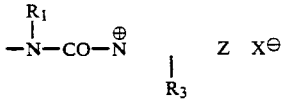

or $R_1$ and $R_2$ together represent the atoms required to complete an optionally substituted heterocyclic ring, for example a piperidine, piperazine or morpholine ring, the ring optionally being substituted, for example, by $C_{1-3}$ alkyl or halogen, $R_3$ is hydrogen, alkyl, aryl, alkoxy, $-NR_4-COR_5$, $-(CH_2)_m-NR_8R_9$, $-(CH_2)_n-CONR_{13}R_{14}$ or

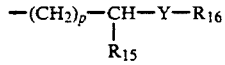

or is a bridge member or a direct bond to a polymer chain, $R_4$, $R_6$, $R_7$, $R_9$, $R_{14}$, $R_{15}$, $R_{17}$, $R_{18}$ and $R_{19}$ being hydrogen or $C_1$-$C_4$ alkyl, $R_5$ being hydrogen, $C_{1-4}$ alkyl or $NR_6R_7$, $R_8$ *being* $-COR_{10}$, $R_{10}$ being $NR_{11}R_{12}$, $R_{11}$ being $C_{1-4}$ alkyl or aryl, particularly phenyl, $R_{12}$ being hydrogen, $C_{1-4}$ alkyl or aryl, particularly phenyl, $R_{13}$ being hydrogen, $C_{1-4}$ alkyl or aryl, particularly phenyl $R_{16}$ being hydrogen, $C_{1-4}$ alkyl, $COR_{18}$ or $CONHR_{19}$, m being a number of 1 to 3, n being a number of 0 to 3, p being a number of 2 to 3 and Y being O or $NR_{17}$ or $R_{13}$ and $R_{14}$ together representing the atoms required to complete an optionally substituted heterocyclic ring, for example a piperidine, piperazine or morpholine ring, the ring optionally being substituted, for example, by $C_{1-3}$ alkyl or halogen, Z being the C atoms required to complete a 5-membered or 6- membered aromatic heterocyclic ring, optionally with a fused benzene ring, and $X^{\ominus}$ is an anion which is unnecessary where an anionic group is already attached to the rest of the molecule;

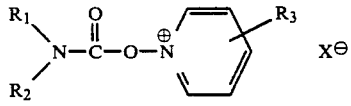

in which $R_1$, $R_2$, $R_3$ and $X^{\ominus}$ are as defined for formula (a).

There are diffusible hardeners which have the same hardening effect on all the layers of a layer combination. However, there are also non-diffusing, low molecular weight and high molecular weight hardeners of which the effect is confined to certain layers. With hardeners of this type, individual layers, for example the protective layer, may be crosslinked particularly highly. This is important where the silver halide layer is minimally hardened to increase the covering power of the silver and the mechanical properties have to be improved through the protective layer (EP-A 0 114 699).

Color photographic negative materials are normally processed by development, bleaching, fixing and washing or by development, bleaching, fixing and stabilization without subsequent washing; bleaching and fixing may be combined into a single process step. Suitable color developer compounds are any developer compounds which are capable of reacting in the form of their oxidation product with color couplers to form azomethine or indophenol dyes. Suitable color developer compounds are aromatic compounds containing at least one primary amino group of the p-phenylenediamine type, for example N,N-dialkyl-p-phenylenediamines, such as N,N-diethyl-p-phenylenediamine,l-(N-ethyl-N-methanesulfonamidoethyl)-3-methyl-p-phenylenediamine, 1-(N-ethyl-N-hydroxyethyl)-3-methyl-p-phenylenediamine and 1-(N-ethyl-N-methoxyethyl)-3-methyl-p-phenylenediamine. Other useful color developers are described, for example, in J. Amer. Chem. Soc. 73, 3106 (1951) and in G. Haist, Modern Photographic Processing, 1979, John Wiley, and Sons, New York, pages 545 et seq.

Color development may be followed by an acidic stop bath or by washing.

The material is normally bleached and fixed immediately after color development. Suitable bleaches are, for example, Fe(III) salts and Fe(III) complex salts, such as ferricyanides, dichromates, water-soluble cobalt complexes. Particularly preferred bleaches are iron(III) complexes of aminopolycarboxylic acids, more especially for example ethylenediamine tetraacetic acid, propylenediamine tetraactic acid, diethylenetriamine pentaacetic acid, nitrilotriacetic acid, iminodiacetic acid, N-hydroxyethyl ethylene diamine triacetic acid, alkyliminodicarboxylic acids, and of corresponding phosphonic acids. Other suitable bleaches are persulfates and peroxides, for example hydrogen peroxide.

The bleaching/fixing bath or fixing bath is generally followed by washing which is carried out in countercurrent or consists of several tanks with their own water supply.

Favorable results can be obtained where a following finishing bath containing little or no formaldehyde is used.

However, washing may be completely replaced by a stabilizing bath which is normally operated in countercurrent. Where formaldehyde is added, this stabilizing bath also performs the function of a finishing bath.

Color reversal materials are first subjected to development with a black-and-white developer of which the oxidation product is not capable of reacting with the color couplers. Development is followed by a diffuse second exposure and then by development with a color developer, bleaching and fixing.

EXAMPLE 1

This Example demonstrates the advantages of the antifogging agents according to the invention in color reversal materials.

Color photographic recording materials for reversal processing are produced by successive application of the following layers to a layer support of cellulose triacetate provided with a coupling layer.

Recording material

1. A red-sensitized silver halide emulsion, mean grain diameter 0.5 μm, containing per kg 70 g gelatine, 60 g silver (96 mol-% in the form of the bromide and 4 mol-% in the form of the iodide) and 55 g of the cyan coupler BG 25.

The silver applied comprises 2.5 g silver nitrate per $m^2$.

2. A 2% by weight aqueous gelatine solution applied in a quantity of 60 g/$m^2$ and containing per kg 4 g of the polymeric white coupler W-2 described in DE-A 23 04 319.

3. A green-sensitized silver halide emulsion, mean grain diameter 0.45 μm, containing per kg 70 g gelatine, 60 g silver (96 mol-% in the form of the bromide and 4 mol-% in the form of the iodide) and 60 g of the magenta coupler PP 12.

The silver applied comprises 2.8 g silver nitrate per $m^2$.

4. A yellow silver dispersion containing per kg 1.8 g silver in the form of silver nitrate and 12 g gelatine. The color density of the yellow filter layer, as measured behind the blue filter, is 0.6; the silver applied comprises 0.2 g silver nitrate per $m^2$.

5. An unsensitized silver halide emulsion, mean grain diameter 0.6 μm, containing per kg 70 g gelatine, 60 g silver (95 mol-% in the form of the bromide and 5 mol-% in the form of the iodide) and 140 g of the yellow coupler GB 2.

The silver applied comprises 1.5 g silver nitrate per $m^2$.

6. A 1% by weight gelatine solution applied in a quantity of 60 g per $m^2$.

7. A 1% by weight aqueous solution of the hardener H-1 in a quantity of 60 g per $m^2$:

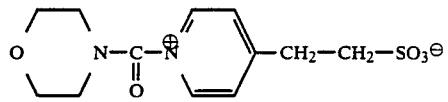

H 1

Samples of the photographic reversal material described above were prepared, the comparison material no. 1 containing no antifogging agents according to the invention. Certain quantities of the compounds according to the invention are added to the silver-halide-containing casting solutions of photographic materials 2 to 7.

The samples prepared in this way were exposed under a step wedge and were subjected to the color reversal development described in "Manual for Processing Kodak Ektachrome Film Using Process E 7", Eastman Kodak Company, 1977 (cf. Kodak Publication no. Z-119).

The following data for the yellow, magenta and cyan layer are shown in the following Table 1.

The measurement parameters mentioned therein are defined as follows:

$$DY = \text{dye yield: } \frac{\text{maximal density}}{\text{silver applied}}$$

$\gamma^1$ slope of gradation curve between the points 0.2 above fog and that point of the gradation curve which results at 6.5 lg I·t weaker exposure sensitivity: 1 g I·t value at density 1.0

$\gamma^1/D_{max}$: standardization of gradation at different maximal densities.

TABLE 1

| Sample | Compound no. | Conc. mg/100 g Ag $NO_3$ | Yellow layer DY | Yellow layer $\tau^1$ | Yellow layer sens. | Yellow layer $\tau^1/D_{max}$ | Magenta layer DY | Magenta layer $\tau^1$ | Magenta layer sens. | Magenta layer $\tau^1/D_{max}$ | Cyan layer DY | Cyan layer $\tau^1$ | Cyan layer sens. | Cyan layer $\tau^1/D_{max}$ | |
|---|---|---|---|---|---|---|---|---|---|---|---|---|---|---|---|
| | — | — | 2.37 | 2.90 | 2.85 | 0.82 | 1.4 | 2.37 | 2.55 | 0.6 | 1.43 | 2.12 | 2.61 | 0.58 | Comparison |
| 2 | A-3 | 250 | 2.51 | 3.19 | 2.72 | 0.85 | 1.68 | 2.85 | 2.39 | 0.61 | 1.5 | 2.59 | 2.59 | 0.69 | Invention |
| 3 | A-4 | 150 | 2.44 | 2.98 | 2.68 | 0.82 | 1.64 | 3.52 | 2.38 | 0.77 | 1.48 | 2.31 | 2.60 | 0.62 | Invention |
| 4 | A-5 | 300 | 2.66 | 3.66 | 2.61 | 0.92 | 1.9 | 3.79 | 2.39 | 0.71 | 1.65 | 2.72 | 2.51 | 0.66 | Invention |
| 5 | A-21 | 200 | 2.66 | 3.61 | 2.48 | 0.90 | 1.63 | 3.8 | 2.27 | 0.83 | 1.81 | 3.24 | 2.49 | 0.72 | Invention |
| 6 | A-23 | 300 | 2.47 | 2.96 | 2.61 | 0.83 | 1.76 | 5.03 | 2.19 | 1.02 | 1.5 | 3.75 | 2.29 | 1.0 | Invention |
| 7 | A-24 | 1000 | 2.47 | 3.26 | 2.73 | 0.88 | 1.67 | 3.08 | 2.35 | 0.66 | 1.61 | 2.33 | 2.43 | 0.59 | Invention |

The test data clearly show that, where the compounds according to the invention are used, there is a distinct increase in the dye yield without any flattening of gradation.

EXAMPLE 2

A high-sensitivity silver bromide iodide emulsion containing 4 mol-% iodide for a gelatine-to-silver ratio by weight of 1.2 and 150 g silver nitrate per kg emulsion was ripened to optimal sensitivity with sulfur and gold compounds.

The emulsion was divided into several parts and the following substances added per kg emulsion:

| | |
|---|---|
| 4-hydroxy-6-methyl-1,3,3a,7-tetraazaindene 1% by weight aqueous alkaline solution | 1.5 g |
| saponin 10% by weight, dissolved in water | 3.5 g |

The compounds according to the invention as shown in the following Table (1% by weight solutions in methanol) were also added in the quantities shown.

The emulsions were then cast onto a cellulose acetate support and dried (silver applied = 6.7 to 7.0 g/m$^2$, expressed as silver nitrate). A protective layer containing a hardener corresponding to the following formula

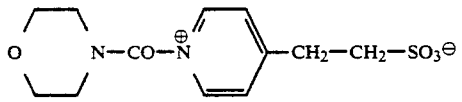

and a wetting agent was applied to the emulsion layer in a thickness of 2 g gelatine/m$^2$ and 340 mg hardener/m$^2$.

The samples were then exposed behind a step wedge in a sensitometer and developed for 7 minutes at 20° C. in a developer of the following composition:

| | |
|---|---|
| p-methylaminophenol | 3.5 g |
| hydroquinone | 3.5 g |
| sodium sulfite | 70.0 g |
| sodium carbonate | 40 0 g |
| potassium bromide | 2.0 g |
| borax | 7.0 g |

made up with water to 1 liter.

The samples were then fixed in the usual way in an acidic fixing bath and washed. The results of the sensitometer tests are shown in Table 2 below. It can be seen that the compounds according to the invention reduce fogging and are therefore suitable as antifogging agents, even if the material is stored at relatively high temperature or humidity.

TABLE 2

| Compound | Quantity mol/mol Ag | $S_F$ | $F_F$ | $S_H$ | $F_H$ | $S_T$ | $F_T$ |
|---|---|---|---|---|---|---|---|
| Control | — | 30.4 | 0.24 | 29.5 | 0.23 | 28.5 | 0.13 |
| Comparison I | $1.7 \cdot 10^{-4}$ | 29.9 | 0.22 | 28.7 | 0.23 | 28.1 | 0.12 |
| " | $3.4 \cdot 10^{-4}$ | 29.5 | 0.24 | 28.8 | 0.18 | 27.2 | 0.12 |
| Comparison II | $1.7 \cdot 10^{-4}$ | 29.9 | 0.22 | 28.9 | 0.27 | 27.9 | 0.13 |
| " | $3.4 \cdot 10^{-4}$ | 29.8 | 0.19 | 28.3 | 0.23 | 27.6 | 0.12 |
| A-1 | $1.7 \cdot 10^{-4}$ | 30.2 | 0.19 | 29.1 | 0.18 | 28.1 | 0.12 |
| A-1 | $3.4 \cdot 10^{-4}$ | 29.6 | 0.18 | 28.9 | 0.17 | 27.4 | 0.10 |
| A-2 | $1.7 \cdot 10^{-4}$ | 30.3 | 0.19 | 29.1 | — | 27.6 | 0,10 |
| A-2 | $3.4 \cdot 10^{-4}$ | 29.4 | 0.17 | 28.7 | 0.16 | 28.2 | 0.09 |
| A-3 | $1.7 \cdot 10^{-4}$ | 30.3 | 0.19 | 29.0 | 0.17 | 27.9 | 0.09 |

TABLE 2-continued

| Compound | Quantity mol/mol Ag | $S_F$ | $F_F$ | $S_H$ | $F_H$ | $S_T$ | $F_T$ |
|---|---|---|---|---|---|---|---|
| A-3 | $3.4 \cdot 10^{-4}$ | 30.5 | 0.13 | 29.1 | 0.13 | 27.5 | 0.08 |

Comparison compound I:

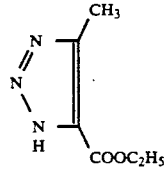

Comparison compound II:

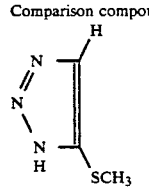

$S_F$ = sensitivity of fresh sample
$F_F$ = fogging of fresh sample
$S_H$ = sensitivity of sample after storage (3 days, 60° C./34% relative humidity)
$F_H$ = fogging of sample after storage (3 days, 60° C./34% relative humidity)
$S_T$ = sensitivity of sample after storage (3 days, 35° C./90% relative humidity)
$F_T$ = fogging of sample after storage (3 days, 35° C./90% relative humidity)

EXAMPLE 3

1.2 g 4-hydroxy-6-methyl-1,3,3a,7-tetraazaindene in the form of an aqueous alkaline solution was added to 1 kg of a green-sensitized silver bromide iodide emulsion containing 5 mol-% iodide for a silver (expressed as silver nitrate) to gelatine ratio by weight of :1:0.4 and 0.91 mol silver halide per kg emulsion and the emulsion thus obtained divided into several equal parts into which the compounds according to the invention, as shown in the following Table, were added in solution in methanol in the quantities shown. Before casting, 75 g of a 5% by weight gelatine solution, 109 g of an 11.1% by weight coupler dispersion of magenta coupler PP 13, wetting agents in aqueous solution and 1180 ml water were added to the emulsion per kg.

The dye corresponding to the following formula

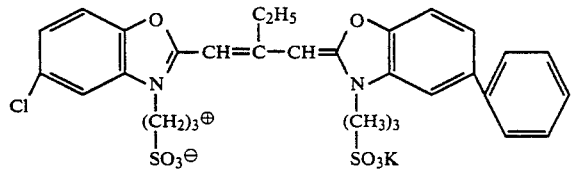

was added as sensitizer in quantities of $2.4 \cdot 10^{-4}$ mol/mol Ag.

The emulsions were cast onto the antihalo layer—consisting of a silver dispersion—of a cellulose acetate support coated with silver in a quantity corresponding to 2.2 to 2.3 g $AgNO_3/m_2$.

The same hardening layer as in Example 2 was applied to the emulsion layer.

The samples were tested fresh, after storage in a heating cabinet for 3 days at 60° C./34% relative air humidity and after storage in a tropical cabinet for 3 days at 35° C./90% relative air humidity.

The samples were then exposed behind a step wedge in a sensitometer and developed in the following developer for 3.25 minutes at 38° C.

| Developer | |
|---|---|
| 1-hydroxyethane-1,1-diphosphonic acid $Na_2$ salt | 2 g |
| ethylenediamine-N,N,N',N,'-tetraacetic acid | 2 g |
| potassium carbonate | 34.1 g |
| sodium hydrogen carbonate | 1.55 g |
| sodium disulfite | 0.28 g |
| sodium sulfite | 3.46 g |
| potassium bromide | 1.34 g |
| hydroxylamine sulfate | 2.4 g |
| 4-amino-3-methyl-N-ethyl-N-(β-hydroxyethyl)-aniline | 4.7 g |

made up with water to 1 liter.

Further processing comprises the following baths:

| | |
|---|---|
| stop bath | 1 minute 38° C.; |
| bleaching bath | 3¼ minutes at 38° C.; |
| washing | 3½ minutes at 38° C.; |
| fixing bath | 3½ minutes at 38° C.; |
| washing | 5 minutes at 38° C. |

The stop, bleaching and fixing baths used correspond to those typically used (British Journal of Photography, 1974, pages 597 and 598).

The results obtained are shown in Table 3.

The compounds according to the invention reduce the high fogging without significantly affecting sensitivity or gradation and improve the stability of the photographic material in storage.

By contrast, the known triazole compounds I and II (identical with those of Example 2) produce less of a reduction in fogging.

TABLE 3

| Compound | Quantity mol/mol Ag | $S_F$ | $F_F$ | $S_H$ | $F_H$ | $S_T$ | $F_T$ |
|---|---|---|---|---|---|---|---|
| Control | — | 33.9 | 0.34 | 33.9 | 0.26 | 33.4 | 0.24 |
| Comparison I | $6.8 \cdot 10^{-4}$ | 34.2 | 0.35 | 34.0 | 0.27 | 33.8 | 0.25 |
| Comparison I | $13.6 \cdot 10^{-4}$ | 34.3 | 0.37 | 34.2 | 0.28 | 32.8 | 02.5 |
| Comparison II | $1.7 \cdot 10^{-4}$ | 34.3 | 0.34 | 34.2 | 0.26 | 33.4 | 0.22 |
| Comparison II | $3.4 \cdot 10^{-4}$ | 34.2 | 0.39 | 34.1 | 0.24 | 33.6 | 0.22 |
| A-1 | $1.7 \cdot 10^{-4}$ | 34.1 | 0.32 | 34.2 | 0.24 | 33.7 | 0.22 |
| A-1 | $3.4 \cdot 10^{-4}$ | 34.2 | 0.29 | 34.1 | 0.18 | 35.5 | 0.20 |
| A-1 | $6.8 \cdot 10^{-4}$ | 33.8 | 0.23 | 33.5 | 0.19 | 32.5 | 0.18 |
| A-1 | $13.6 \cdot 10^{-4}$ | 33.2 | 0.17 | 33.5 | 0.18 | 32.7 | 0.18 |
| A-2 | $1.7 \cdot 10^{-4}$ | 34.4 | 0.33 | 34.2 | 0.21 | 32.9 | — |
| A-2 | $3.4 \cdot 10^{-4}$ | 34.1 | 0.30 | — | 0.21 | 32.7 | 0.22 |
| A-2 | $6.8 \cdot 10^{-4}$ | 33.4 | 0.20 | 33.3 | 0.17 | 32.7 | 0.20 |
| A-2 | $13.6 \cdot 10^{-4}$ | — | 0.13 | 32.9 | 0.13 | 32.8 | 0.18 |
| A-3 | $1.7 \cdot 10^{-4}$ | 34.3 | 0.30 | 34.1 | 0.21 | 33.9 | 0.24 |
| A-3 | $3.4 \cdot 10^{-4}$ | 34.2 | 0.28 | 34.4 | 0.22 | 33.8 | 0.21 |
| A-3 | $6.8 \cdot 10^{-4}$ | 33.8 | 0.27 | 34.1 | 0.23 | 33.4 | 0.19 |
| A-3 | $13.6 \cdot 10^{-4}$ | 33.4 | 0.25 | 33.4 | 0.22 | 32.9 | 0.20 |
| A-16 | $3.4 \cdot 10^{-4}$ | 33.5 | 0.27 | 33.4 | 0.20 | 33.4 | 0.20 |
| A-16 | $6.0 \cdot 10^{-4}$ | 33.1 | 0.25 | 33.1 | 0.18 | 32.9 | 0.22 |
| A-16 | $13.6 \cdot 10^{-4}$ | 32.8 | 0.19 | 37.7 | 0.14 | 32.6 | 0.18 |
| A-17 | $3.4 \cdot 10^{-4}$ | 33.6 | 0.33 | 33.6 | 0.25 | 33.3 | 0.23 |
| A-17 | $6.8 \cdot 10^{-4}$ | 33.4 | 0.29 | 35.5 | 0.25 | 33.6 | — |
| A-17 | $13.6 \cdot 10^{-4}$ | 33.1 | 0.20 | 33.2 | 0.14 | 33.3 | 0.22 |
| A-18 | $2 \cdot 10^{-4}$ | 33.5 | 0.32 | 33.6 | 0.25 | 33.9 | 0.22 |
| A-18 | $4 \cdot 10^{-4}$ | 33.5 | 0.30 | 33.3 | 0.24 | 33.7 | 0.22 |
| A-18 | $8 \cdot 10^{-4}$ | 33.1 | 0.25 | 33.0 | 0.20 | 33.9 | 0.23 |
| A-19 | $2 \cdot 10^{-4}$ | 33.3 | 0.32 | 33.5 | 0.24 | 33.3 | 0.22 |
| A-19 | $4 \cdot 10^{-4}$ | 33.1 | 0.27 | 33.0 | 0.20 | 33.6 | 0.20 |
| A-19 | $8 \cdot 10^{-4}$ | 32.9 | 0.17 | 33.1 | 0.13 | 33.4 | 0.21 |
| A-20 | $2 \cdot 10^{-4}$ | 33.4 | 0.28 | 33.5 | 0.21 | 33.4 | 0.21 |
| A-20 | $4 \cdot 10^{-4}$ | 33.5 | 0.25 | 33.3 | 0.18 | 33.3 | 0.22 |
| A-20 | $8 \cdot 10^{-4}$ | 33.2 | 0.16 | 33.1 | 0.12 | 33.3 | 0.21 |
| A-21 | $2 \cdot 10^{-4}$ | 33.6 | 0.33 | 33.6 | 0.25 | 33.4 | 0.22 |
| A-21 | $4 \cdot 10^{-4}$ | 33.5 | 0.28 | 33.1 | 0.21 | 33.3 | 0.21 |
| A-21 | $8 \cdot 10^{-4}$ | 33.1 | 0.21 | 32.8 | 0.14 | 33.2 | 0.20 |
| A-22 | $2 \cdot 10^{-4}$ | 33.5 | 0.29 | 33.5 | 0.22 | 33.2 | 0.21 |
| A-22 | $4 \cdot 10^{-4}$ | 33.7 | 0.23 | 33.6 | 0.19 | 32.9 | 0.20 |
| A-22 | $8 \cdot 10^{-4}$ | 33.2 | 0.16 | 32.9 | 0.12 | 33.0 | 0.21 |
| A-23 | $2 \cdot 10^{-4}$ | 33.6 | 0.32 | 33.4 | 0.26 | 33.6 | 0.21 |
| A-23 | $4 \cdot 10^{-4}$ | 33.7 | 0.31 | 32.8 | 0.24 | 33.7 | 0.20 |
| A-23 | $6 \cdot 10^{-4}$ | 33.3 | 0.28 | 33.1 | 0.22 | 33.1 | 0.19 |

$S_F$ = sensitivity of fresh sample
$F_F$ = fogging of fresh sample
$S_H$ = sensitivity of sample after storage (3 days, 60° C./34% relative humidity)
$F_H$ = fogging of sample after storage (3 days, 60° C./34% relative humidity)
$S_T$ = sensitivity of sample after storage (3 days, 35° C./90% relative humidity)
$F_T$ = fogging of sample after storage (3 days, 35° C./90% relative humidity)

What is claimed is:

1. A photographic recording material comprising a layer support and at least one photosensitive silver halide emulsion layer arranged thereon, characterized in that the at least one silver halide emulsion layer contains an antifogging agent corresponding to formula (I)

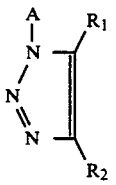

(I)

in which

A represents H, the cation of a metal atom or nonmetal group, a group attached by a covalent bond to the nitrogen atom of the triazole which is only eliminated during processing of the material with release of the triazole, selected from the group consisting of

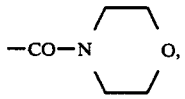

—CO—N(CH₃)₂, —COCH₃, —SO₂N(CH₃)₂ and —SO₂CH₃

$R_1$ represents $C_1$–$C_9$ alkyl, $C_2$–$C_8$ alkenyl, $C_6$–$C_{10}$ aryl, $SR_3$, $R_2$ represents H, $C_1$–$C_9$ alkyl, $C_2$–$C_8$ alkenyl, $C_6$–$C_{10}$ aryl, $C_5$–$C_{10}$ heteroaryl, Cl, Br, —$COOR_3$, —$COR_3$, —$OCOR_3$, $R_3$ represents $C_1$–$C_9$ alkyl, $C_2$–$C_8$ alkenyl, $C_6$–$C_{10}$ aryl, $C_5$–$C_{10}$ heteroaryl, the sum of the carbon atoms in the substituents $R_1$, $R_2$ and $R_3$ being equal to or greater than 5 where $R_2$ is a carboxylic ester group in a quantity of from $10^{-5}$ to $10^{-2}$ mol per mol silver halide.

2. A photographic recording material as claimed in claim 1, characterized in that it is a color photographic recording material comprising a layer support and, arranged thereon, at least three photosensitive silver halide emulsion layers of different spectral sensitivity with which a yellow coupler, a magenta coupler and a cyan coupler are respectively spectrally associated.

* * * * *